US010255895B2

(12) United States Patent
Takasaki et al.

(10) Patent No.: US 10,255,895 B2
(45) Date of Patent: Apr. 9, 2019

(54) ELECTRONIC PERCUSSION INSTRUMENT

(71) Applicant: Roland Corporation, Shizuoka (JP)

(72) Inventors: Ryo Takasaki, Shizuoka (JP); Yoshiaki Mori, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 15/687,553

(22) Filed: Aug. 28, 2017

(65) Prior Publication Data

US 2018/0061386 A1 Mar. 1, 2018

(30) Foreign Application Priority Data

Aug. 30, 2016 (JP) ..... 2016-168457
Aug. 30, 2016 (JP) ..... 2016-168458
Aug. 30, 2016 (JP) ..... 2016-168459

(51) Int. Cl.
*G10H 3/00* (2006.01)
*G10H 3/14* (2006.01)
*G10H 1/32* (2006.01)

(52) U.S. Cl.
CPC ..... *G10H 3/146* (2013.01); *G10H 1/32* (2013.01); *G10H 3/143* (2013.01); *G10H 2220/161* (2013.01); *G10H 2220/525* (2013.01); *G10H 2230/285* (2013.01)

(58) Field of Classification Search
CPC ..... G10H 3/00; G10H 3/143; G10H 3/146; G10H 2220/525; G10H 2220/561; G10D 13/00; G10D 13/02; G10D 13/027; B25D 2250/221
See application file for complete search history.

(56) References Cited

U.S. PATENT DOCUMENTS 5,856,628 A * 1/1999 Noguchi ..... G10H 3/146 84/421
5,920,026 A 7/1999 Yoshino et al.
(Continued)

FOREIGN PATENT DOCUMENTS

EP 3208796 8/2017
IT BO20110173 10/2012
(Continued)

OTHER PUBLICATIONS

"Search Report of European Counterpart Application," dated Feb. 6, 2018, p. 1-p. 8.
(Continued)

*Primary Examiner* — Marlon Fletcher
(74) *Attorney, Agent, or Firm* — JCIPRNET

(57) ABSTRACT

There is provided an electronic percussion instrument. The electronic percussion instrument includes a struck surface and a plurality of strike sensors configured to detect a strike on the struck surface. The plurality of strike sensors include at least one central sensor that is disposed on a back side of the struck surface and disposed at a center side of the struck surface and a plurality of peripheral sensors that are disposed on a peripheral side of the struck surface. The central sensor and the peripheral sensors each have the same structure. The peripheral sensors are configured to transmit a strike signal in a shorter time than the central sensor when the struck surface is struck.

14 Claims, 10 Drawing Sheets

(56) References Cited

U.S. PATENT DOCUMENTS

| | | | | |
|---|---|---|---|---|
| 8,563,843 | B1 * | 10/2013 | Shemesh | G10H 7/00 84/723 |
| 8,816,181 | B2 | 8/2014 | Shemesh | |
| 8,940,991 | B2 | 1/2015 | Shemesh | |
| 9,006,553 | B2 | 4/2015 | Mori | |
| 9,424,827 | B2 | 8/2016 | Gill et al. | |
| 2008/0250914 | A1 * | 10/2008 | Reinhart | G10H 1/0025 84/645 |
| 2010/0307323 | A1 * | 12/2010 | Mori | G10D 13/023 84/723 |
| 2013/0180388 | A1 * | 7/2013 | Mori | G10H 3/14 84/723 |
| 2014/0020548 | A1 | 1/2014 | Shemesh | |
| 2014/0260917 | A1 * | 9/2014 | Kanayama | G10H 3/143 84/730 |
| 2014/0260918 | A1 * | 9/2014 | Kanayama | G10H 3/146 84/730 |
| 2014/0260920 | A1 * | 9/2014 | Kanayama | G10H 3/146 84/730 |
| 2015/0294658 | A1 | 10/2015 | Gill et al. | |
| 2016/0086590 | A1 * | 3/2016 | Iwase | G10H 1/344 84/744 |
| 2018/0061388 | A1 * | 3/2018 | Takasaki | G10H 1/32 |

FOREIGN PATENT DOCUMENTS

| | | |
|---|---|---|
| JP | S54-172726 | 5/1978 |
| JP | S62-501653 | 7/1987 |
| JP | H05-232943 | 9/1993 |
| JP | H10-020854 | 1/1998 |
| JP | H10-111690 | 4/1998 |
| JP | 2005-037922 | 2/2005 |
| JP | 2009037041 | 2/2009 |
| JP | 2009-186886 | 8/2009 |
| JP | 2011018071 | 1/2011 |
| JP | 2011-158594 | 8/2011 |
| JP | 2012-203191 | 10/2012 |
| JP | 2014-119664 | 6/2014 |
| JP | 2014-524008 | 9/2014 |
| WO | 8604718 | 8/1986 |
| WO | 2012122608 | 9/2012 |

OTHER PUBLICATIONS

"Response to Office Action of European Counterpart Application," filed on Aug. 28, 2018, p. 1-p. 25.

"Office Action of Europe Counterpart Application," dated Oct. 1, 2018, p. 1-p. 6.

"Response to Office Action of European Counterpart Application," submitted on Jan. 30, 2019, pp. 1-27.

* cited by examiner

CENTRAL SENSOR STRIKE POSITION TABLE 72b

| PITCH ΔThw OF INITIAL HALF WAVE(ms) | STRIKE POSITION |
|---|---|
| 0.0≦ΔThw<0.2 | 127 |
| 0.2≦ΔThw<0.4 | 100 |
| 0.4≦ΔThw<0.6 | 70 |
| : | : |
| 1.8≦ΔThw | 0 |

FIG. 5(a)

PERIPHERAL SENSOR STRIKE POSITION TABLE 72c

| TIME DIFFERENCE ΔT2(ms) | TIME DIFFERENCE ΔT1(ms) | | | | |
|---|---|---|---|---|---|
| | 0.0≦ΔT1<0.2 | 0.2≦ΔT1<0.4 | 0.4≦ΔT1<0.6 | : | 1.8≦ΔT1 |
| 0.0≦ΔT2<0.2 | 0 | 10 | 25 | : | 45 |
| 0.2≦ΔT2<0.4 | 10 | 20 | 25 | : | 50 |
| 0.4≦ΔT2<0.6 | 25 | 30 | 33 | : | 60 |
| : | : | : | : | : | : |
| 1.8≦ΔT2 | 45 | 50 | 55 | : | 100 |

FIG. 5(b)

SENSOR VALUE RING BUFFER 73b

| No. | CENTRAL SENSOR VALUE MEMORY (73b1) | FIRST PERIPHERAL SENSOR VALUE MEMORY (73b2) | SECOND PERIPHERAL SENSOR VALUE MEMORY (73b3) | THIRD PERIPHERAL SENSOR VALUE MEMORY (73b4) |
|---|---|---|---|---|
| 1 | 20 | 41 | 52 | 33 |
| 2 | 80 | 62 | 33 | 25 |
| 3 | 42 | 72 | 60 | 20 |
| : | : | : | : | : |
| 50 | 33 | 41 | 13 | 25 |

FIG. 5(c)

ELECTRONIC PERCUSSION INSTRUMENT

CROSS-REFERENCE TO RELATED APPLICATION

This application claims the priority benefit of Japan application serial no. 2016-168457, 2016-168458 and 2016-168459, all of which were filed on Aug. 30, 2016. The entirety of each of the above-mentioned patent applications is hereby incorporated by reference herein and made a part of this specification.

BACKGROUND OF THE INVENTION

Field of the Invention

The present invention relates to an electronic percussion instrument. Particularly, the present invention relates to an electronic percussion instrument through which it is possible to shorten a delay time of sound production control while reducing manufacturing costs, and it is possible to prevent a decrease in detection sensitivity of a strike on a peripheral side of a struck surface.

Description of Related Art

Various electronic drums have been developed as one type of electronic percussion instrument. In such electronic drums, strike sensors configured to detect a strike are disposed at a central portion of a struck surface and at an outer peripheral portion (a peripheral portion) of the struck surface. Therefore, in these electronic drums, based on results detected by the strike sensors, a strike strength and a strike position are detected, and striking sound production is controlled. In electronic drums in Patent Literatures 1 and 2 (Japanese Utility Model Publication No. S54-172726 and Japanese Patent Publication No. 2012-203191), one strike sensor is disposed at a central portion of the struck surface and four strike sensors are disposed at peripheral portions of the struck surface. In addition, in an electronic drum in Patent Literature 3 (Japanese Patent Publication No. 2009-186886), one strike sensor is disposed at a central portion of the struck surface and an annular ring sensor is disposed at a peripheral portion of the struck surface. In electronic drums in Patent Literatures 4 to 6 (U.S. Pat. No. 8,563,843, U.S. Pat. No. 8,816,181 and U.S. Pat. No. 8,940,991), one strike sensor is disposed at a central portion of the struck surface and a plurality of strike sensors supporting an annular carrier are disposed at peripheral portions of the struck surface.

However, in the electronic drums in Patent Literatures 1 and 2, the strike sensor at the center and the strike sensors at the peripheral portions have the same structure. Therefore, in the peripheral portion in which a vibration (an amplitude) of the struck surface is lower than that of the central portion of the struck surface, strike detection sensitivity decreases. In addition, when the central portion of the struck surface is struck, a time is required until the strike sensor at the center detects the strike, the peripheral strike sensor then detects the strike, and required information such as a signal arrival time and a peak level can be acquired. Therefore, a delay time until striking sound production is controlled is lengthened. Moreover, there is a problem in that such a phenomenon becomes significant as a diameter of the struck surface increases.

In addition, in the electronic drums in Patent Literatures 3 to 6, the structures of the strike sensor at the center and the annular ring sensor and carrier at the peripheral portions are completely different. Therefore, manufacturing costs of the electronic drums inevitably increase. Moreover, there is a problem in that it is necessary to match characteristics (such as a waveform, a level, and a reaction time) of strike outputs from sensors having different structures.

PRIOR ART LITERATURE

Patent Literature 1: Japanese Utility Model Publication No. S54-172726
Patent Literature 2: Japanese Patent Publication No. 2012-203191
Patent Literature 3: Japanese Patent Publication No. 2009-186886
Patent Literature 4: U.S. Pat. No. 8,563,843
Patent Literature 5: U.S. Pat. No. 8,816,181
Patent Literature 6: U.S. Pat. No. 8,940,991

SUMMARY OF THE INVENTION

An object of the present invention is to provide an electronic percussion instrument through which it is possible to shorten a delay time of sound production control while reducing manufacturing costs, and it is possible to prevent a decrease in detection sensitivity of a strike on a peripheral side of a struck surface.

According to one of embodiments of the present invention, an electronic percussion instrument includes a struck surface and a plurality of strike sensors configured to detect a strike on the struck surface. Here, the plurality of strike sensors are disposed on an back side of the struck surface. Furthermore, at least one central sensor disposed at a center side of the struck surface and the plurality of peripheral sensors disposed on a peripheral side of the struck surface are included. The central sensor and the peripheral sensors each have the same structure. The peripheral sensors are configured to transmit a strike signal in a shorter time than the central sensor when the struck surface is struck.

According to one of the embodiments of the present invention, the peripheral sensors are disposed at closer positions to the struck surface than the central sensor.

According to one of the embodiments of the present invention, the central sensor and the peripheral sensors each include a cushion member in contact with the struck surface and a head sensor disposed on a bottom surface of the cushion member.

According to one of the embodiments of the present invention, an interval between the head sensor of each of the peripheral sensors and the struck surface is shorter than an interval between the head sensor of the central sensor and the struck surface.

According to one of the embodiments of the present invention, each of the plurality of strike sensors are disposed on the back side of the struck surface with a cushion member therebetween, and the cushion member of each of the peripheral sensors is formed to be thinner than the cushion member of the central sensor.

A situation that the bottom of the struck surface compresses the cushion member to an excessive extent and bring the struck surface most close to the head sensor is called bottoming-out. According to one of the embodiments of the present invention, the cushion member of each of the plurality of strike sensors is formed with thickness at which, when each of locations of the strike sensors on the struck surface is hit, the struck surface does not bottom out on the head sensor. Thus, the bottom of the struck surface does not compress the cushion member to an excessive extent and bring the struck surface most close to the head sensor.

According to one of the embodiments of the present invention, the cushion member of each of the plurality of strike sensors is formed with thickness of about 1.5 to 2 times an amount of deflection of the struck surface when each of locations of the strike sensors on the struck surface is hit.

According to one of the embodiments of the present invention, when the struck surface is hit, the struck surface has a first deflection amount at the center side where the central sensor is disposed and a second deflection amount on the peripheral side where the peripheral sensors are disposed. The thickness of the cushion member of the central sensor is 1.75 times the first deflection amount. The thickness of the cushion member of each of the peripheral sensors is 1.78 times the second deflection amount.

According to one of the embodiments of the present invention, the cushion member of each of the peripheral sensors is formed with thickness at which, when a center of the struck surface is struck, a peak value of the strike is able to be detected within a predetermined time.

According to one of the embodiments of the present invention, the at least one central sensor is one central sensor and the plurality of peripheral sensors are at least three peripheral sensors. The peripheral sensors are disposed along a circumference centered on the central sensor.

According to one of the embodiments of the present invention, when the struck surface is viewed in a plan view, the plurality of peripheral sensors are at least three peripheral sensors disposed to surround the central sensor.

According to one of the embodiments of the present invention, the peripheral sensors are disposed along a circumference centered on the central sensor or a line of a polygonal shape or an elliptical shape to surround the central sensor.

According to one of the embodiments of the present invention, the peripheral sensors are disposed at equal intervals.

According to one of the embodiments of the present invention, the cushion member of each of the peripheral sensors and the central sensor includes an elastic material, and a hardness of the elastic material of the cushion member of each of the peripheral sensors is higher than a hardness of the elastic material of the cushion member of the central sensor.

According to one of the embodiments of the present invention, the at least one central sensor is a plurality of central centers. The electronic percussion instrument calculates a strike position based on an average value of strike results detected by the plurality of central sensors.

According to one of the embodiments of the present invention, the central sensor disposed at the center side of the struck surface and each of the peripheral sensors disposed on peripheral sides of the struck surface have the same structure. Therefore, compared to when strike sensors having different structures are used, it is possible to reduce manufacturing costs of the electronic drum. Moreover, there is no need to match characteristics of the strike outputs of the strike sensors at the center and on the peripheral sides. Therefore, a design can be simplified accordingly. Moreover, the peripheral sensors are configured to transmit a strike signal in a shorter time than the central sensor when the struck surface is struck. Therefore, when a central portion of the struck surface is struck, it is possible to shorten a time from when the central sensor detects the strike until the peripheral sensors detect the strike. Accordingly, it is possible to shorten a delay time of sound production control.

According to one of the embodiments of the present invention, the peripheral sensors are disposed at closer positions to the struck surface than the central sensor. Therefore, when the central portion of the struck surface is struck, it is possible to shorten a time from when the central sensor detects the strike until the peripheral sensors detect the strike. Accordingly, it is possible to shorten a delay time of sound production control.

In addition, when the central portion of the struck surface is struck, a vibration (an amplitude) of the strike is lower in the peripheral portions than in the central portion of the struck surface. Therefore, strike detection sensitivity decreases accordingly. However, according to one of the embodiments of the present invention, the peripheral sensors are disposed at closer positions to the struck surface than the central sensor. Therefore, it is possible to compensate for such a decrease in detection sensitivity.

According to one of the embodiments of the present invention, each of the strike sensors are disposed on the back side of the struck surface with a cushion member therebetween. Therefore, even if positions directly above the strike sensors are struck, the strike sensors are protected by the cushion members, and damage thereto can be prevented. In addition, generally, in the electronic percussion instrument, the struck surface is stretched while tension is applied to the outer peripheral end. Therefore, an amount of deflection of the struck surface when struck is large in the central portion and is smaller in the peripheral portions than in the central portion. In the electronic percussion instrument, according to the amount of deflection of the struck surface when struck, the cushion member at the center of the struck surface is formed to be thicker than the cushion members on the peripheral sides. That is, the cushion members on the peripheral sides of the struck surface are formed to be thinner than the cushion member at the center. In this manner, the strike sensors on the peripheral sides of the struck surface can be disposed at closer positions to the struck surface than the strike sensor at the center of the struck surface. Therefore, the thicknesses of the cushion members are changed according to an amount of deflection of the struck surface. Accordingly, the strike sensors can be protected by the cushion members and disposition positions of the strike sensors from the struck surface can be appropriately adjusted at the center and on the peripheral sides of the struck surface.

According to one of the embodiments of the present invention, when the struck surface is viewed in a plan view, the at least one central sensor is one central sensor and the plurality of peripheral sensors are at least three peripheral sensors. The at least three peripheral sensors are disposed along a circumference centered on the central sensor at equal intervals or unequal intervals. Therefore, according to a difference in detection results of strike signals detected by the at least three peripheral sensors, it is possible to detect a strike position from the center of the struck surface in the circumference in which the three peripheral sensors are disposed. Further, according to a detected waveform of the strike signal obtained by one central sensor, it is possible to detect a strike position from the center of the struck surface outside the circumference in which three peripheral sensors are disposed. That is, it is possible to appropriately detect the strike position from the center of the struck surface. Here, the shape of the struck surface may be any shape, for example, a circular shape or a rectangular shape.

BRIEF DESCRIPTION OF THE DRAWINGS

FIG. 5(*a*) is a diagram schematically showing a central sensor strike position table.

FIG. 5(*b*) is a diagram schematically showing a peripheral sensor strike position table.

FIG. 5(*c*) is a diagram schematically showing a sensor value ring buffer.

FIG. 6(*b*) is a voltage and time graph of voltage waveforms in a first peripheral sensor, a second peripheral sensor, and a third peripheral sensor which are detected with respect to a certain strike on a struck surface of the electronic drum.

FIG. 7(*b*) is a flowchart of a MIDI reception process.

DESCRIPTION OF THE EMBODIMENTS

Figure 1:
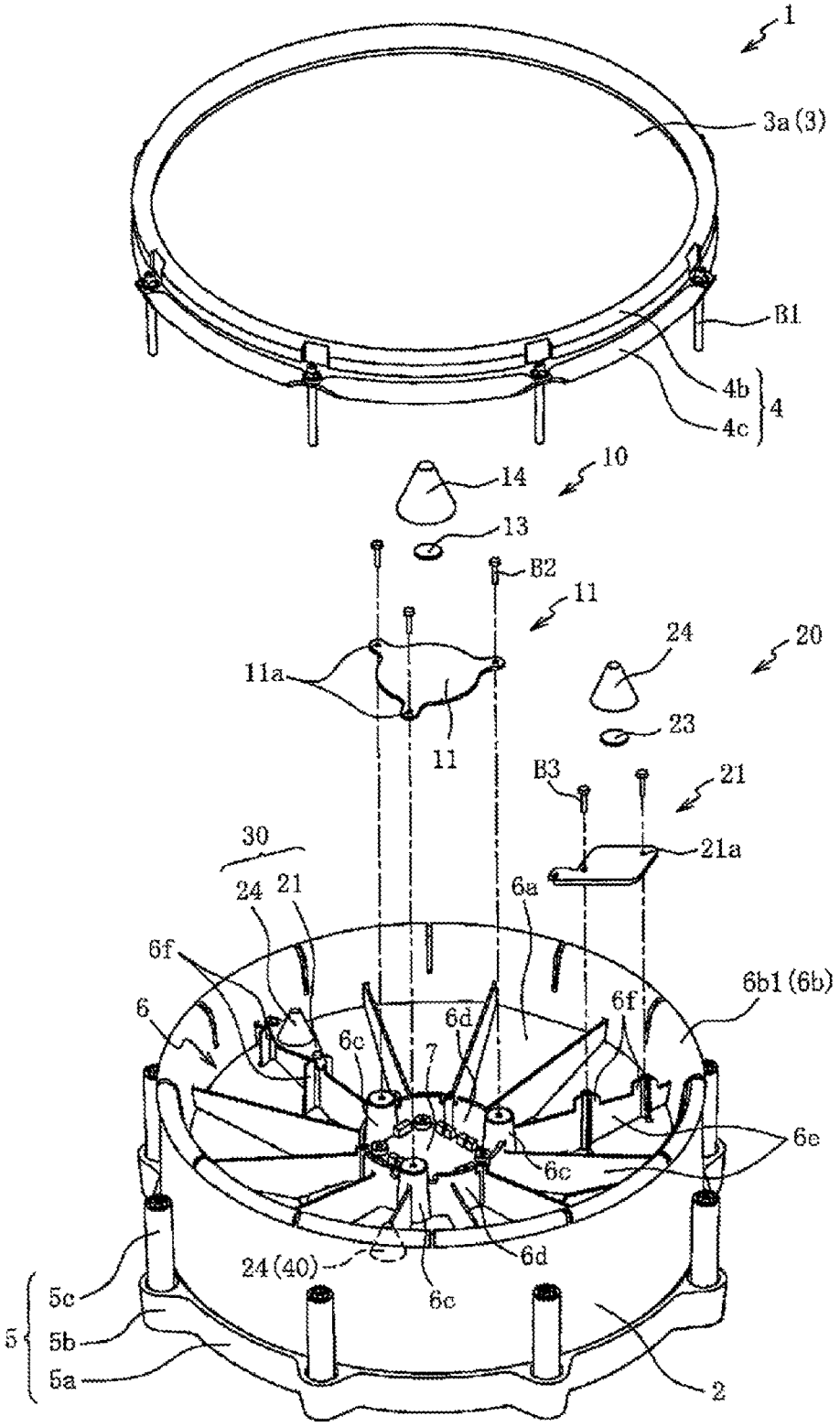
FIG. 1 is an exploded perspective view of an electronic drum according to an embodiment of the present invention.
Figure 2:
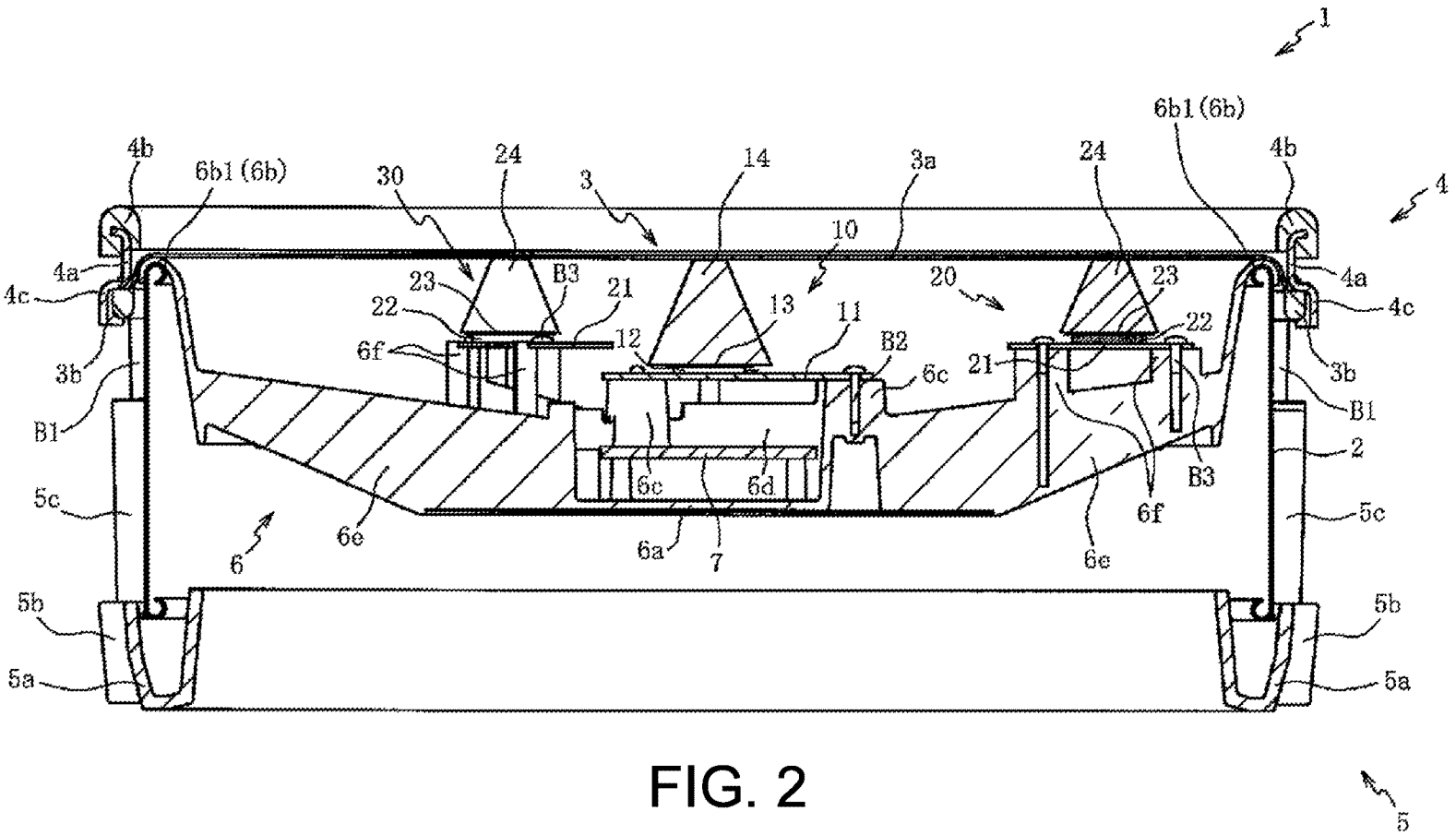
FIG. 2 is a cross-sectional view of the electronic drum.

Preferable embodiments of the present invention will be described below with reference to the appended drawings. First, an overall configuration of an electronic drum 1 will be described with reference to FIG. 1 and FIG. 2. FIG. 1 is an exploded perspective view of the electronic drum 1 according to an embodiment of the present invention. FIG. 2 is a cross-sectional view of the electronic drum 1. Here, in FIG. 1 and FIG. 2, a part of the electronic drum 1 is not shown in order to facilitate understanding. In addition, the upper side in FIG. 1 and FIG. 2 is defined as the upper part of the electronic drum 1 and the lower side thereof is defined as the lower part of the electronic drum 1.

As shown in FIG. 1, the electronic drum 1 is an electronic percussion instrument simulating a drum which is played using a stick or the like held by a performer. The electronic drum 1 comprises a shell 2, a head 3, a rim 4, a fixing portion 5, a frame 6, a control device 7, a central sensor 10, and a plurality of peripheral sensors (a first peripheral sensor 20, a second peripheral sensor 30, and a third peripheral sensor 40). The shell 2 has an upper end (an upper end in FIG. 1 and FIG. 2) that is open. The head 3 covers the opening of the upper end of the shell 2. The rim 4 is connected to the outer edge of the head 3. The rim 4 is attached to the fixing portion 5. The frame 6 is disposed to face the head 3 and is disposed on the inner circumference side of the shell 2. The control device 7 is supported by the frame 6. The central sensor 10 is disposed between the head 3 and the frame 6 and is disposed on the center of a struck surface (a film member 3*a* to be described below) in a plan view. The plurality of peripheral sensors (the first peripheral sensor 20, the second peripheral sensor 30, and the third peripheral sensor 40) are disposed on the peripheral sides of the struck surface (the outside in the radial direction of the film member 3*a*) in a plan view relative to the central sensor 10.

Figure 4:
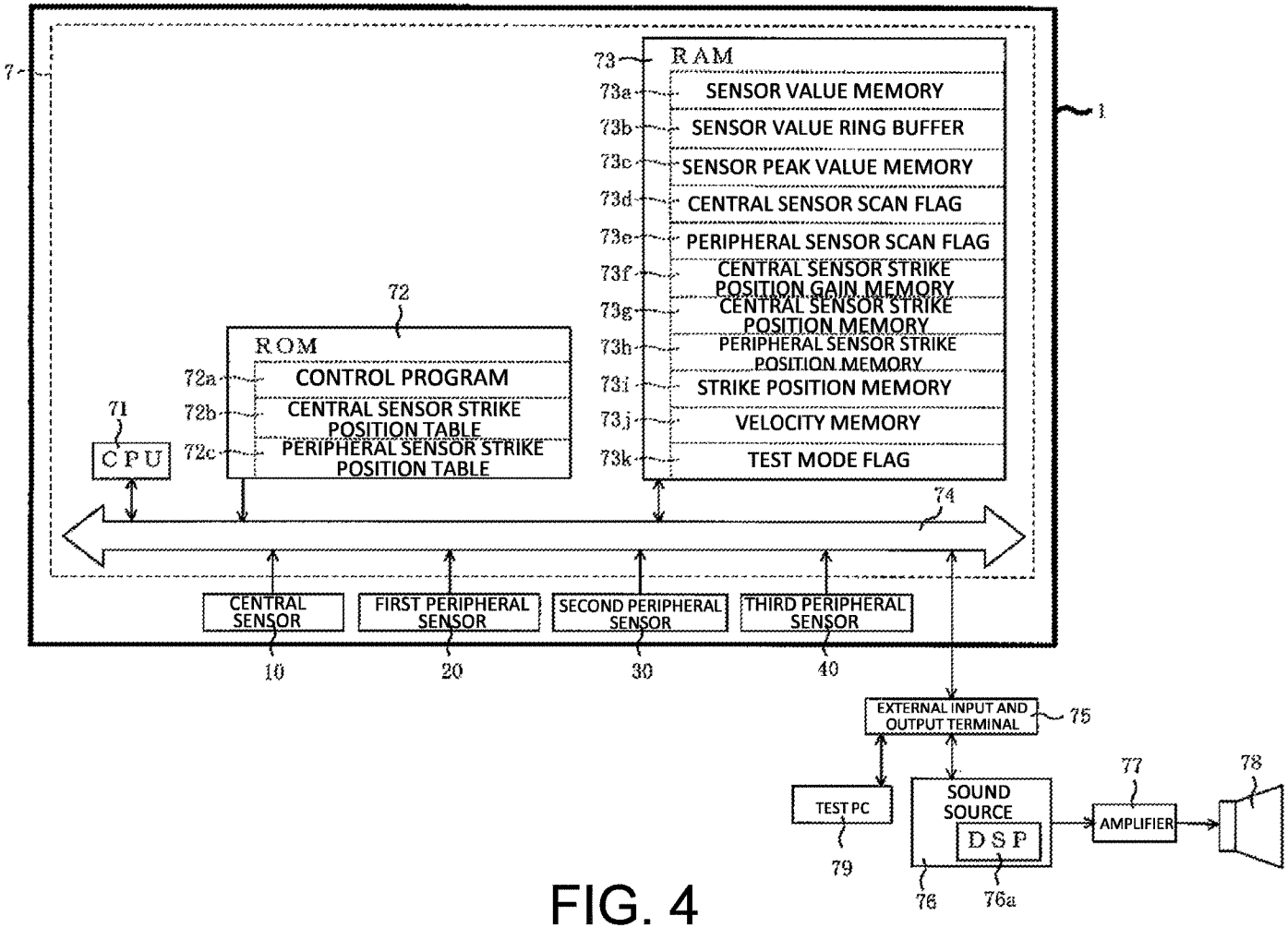
FIG. 4 is a block diagram showing an electrical configuration of the electronic drum.

When a performer strikes the struck surface using a stick (not shown) or the like, the electronic drum 1 outputs results detected from the central sensor 10 and the first peripheral sensor 20 to the third peripheral sensor 40 based on the strike to a sound source 76 (refer to FIG. 4). A musical sound signal based on the detection results is generated by the sound source 76. The musical sound signal is output to a speaker 78 through an amplifier 77 (refer to FIG. 4), and an electronic musical sound based on the musical sound signal is emitted from the speaker 78.

The shell 2 is formed in a cylindrical shape with both ends in the axial direction (both upper and lower ends) being open and with an outer diameter that is 14 inches. Here, the outer diameter of the shell 2 is not limited to 14 inches, and the outer diameter can be set to less than 14 inches or greater than 14 inches.

The head 3 comprises the film member 3*a* that is formed as the struck surface and an annular frame portion 3*b* to which the outer edge of the film member 3*a* is bonded. The film member 3*a* has a disk shape and is formed of a mesh-like material obtained by weaving synthetic fibers or a film-like material including a synthetic resin. The frame portion 3*b* is formed of a synthetic resin or a metallic material, and the film member 3*a* is fixed to the frame portion 3*b*.

The rim 4 is an annular member that applies a tension to the head 3. The rim 4 comprises a cylindrical frame contact portion 4*a*, an annular elastic member 4*b*, and an annular flange portion 4*c*. The frame contact portion 4*a* has a lower end (an end on the side of the fixing portion 5 and an end on the lower side of FIG. 2) that is in contact with the frame portion 3*b*. The elastic member 4*b* is disposed along the entire circumference on an upper end (an end on the side opposite to the end in contact with the frame portion 3*b*) of the frame contact portion 4*a*. The flange portion 4*c* projects from the lower end of the frame contact portion 4*a* toward the outside in the radial direction.

The frame contact portion 4*a* is a portion that applies a fastening force of a bolt B1 (to be described below) to the frame portion 3*b* and stretches the film member 3*a*. The inner diameter of the frame contact portion 4*a* is set to be greater than the outer diameter of the shell 2 and smaller than the outer diameter of the frame portion 3*b*. The elastic member 4*b* is a portion that is struck by a performer and is formed of an elastic material such as sponge, rubber, and a thermoplastic elastomer. In the flange portion 4*c*, a plurality of through holes into which the bolts B1 are inserted are formed at positions corresponding to fastened portions 5*c* (to be described below).

The fixing portion 5 is a member for fixing the head 3 and the rim 4 to the shell 2. The fixing portion 5 comprises an annular portion 5*a*, a plurality of projections 5*b*, and a plurality of fastened portions 5*c*. The annular portion 5*a* is fixed to the lower end (the lower end in FIG. 2) of the shell 2. The plurality of projections 5*b* are formed to project from the annular portion 5*a* toward the outside in the radial direction. The plurality of fastened portions 5*c* stand upward from the plurality of projections 5*b*.

The annular portion 5*a* has an annular shape and is formed of a synthetic resin or a metallic material. The annular portion 5*a* and the projection 5*b* are integrally formed. The fastened portion 5*c* is fixed to the projection 5*b* by a screw (not shown). The fastened portion 5*c* has a cylindrical shape, and is formed of a metallic material and has an inner circumferential surface on which a female screw is formed. When the bolts B1 inserted into the flange portions 4*c* are screwed into the fastened portions 5*c*, the head 3 and the rim 4 are fixed to the shell 2.

The frame 6 is a bowl-shaped member that supports various members such as the central sensor 10 and the first peripheral sensor 20 to the third peripheral sensor 40 on the inner circumference side of the shell 2. The frame 6 is formed of a synthetic resin. The frame 6 comprises a bottom 6*a*, a side wall 6*b*, a plurality of central protrusions 6*c*, a connecting portion 6*d*, a plurality of ribs 6*e*, and a peripheral protrusion 6*f*. The bottom 6*a* is arranged to face the head 3 with a predetermined distance therebetween. The side wall 6*b* stands from the outer edge of the bottom 6*a*. The plurality of central protrusions 6*c* stand from the bottom 6*a* to the head 3 side. The connecting portions 6*d* connect the plurality of central protrusions 6*c*. The plurality of ribs 6*e* radially extend toward the side wall 6*b* from the central protrusions 6*c* and the connecting portions 6*d*. The peripheral protrusions 6*f* are integrally formed with the ribs 6*e*.

On the upper end of the side wall 6*b*, a curved portion 6*b*1 that projects toward the outside in the radial direction and is curved downward is formed. When the curved portion 6*b*1 is engaged along the edge of the upper end of the shell 2, the frame 6 is supported at the edge of the opening on the upper end side of the shell 2.

The central protrusion 6*c* is a portion to which the central sensor 10 is attached. A base end of the central protrusion 6*c* is integrally formed with the bottom 6*a*. The plurality of central protrusions 6*c* (three central protrusions 6*c* in the present embodiment) are disposed in the circumferential direction of the shell 2. The connecting portions 6*d* are formed to connect the plurality of central protrusions 6*c* in the circumferential direction of the shell 2. The plurality of ribs 6*e* (twelve ribs 6*e* in the present embodiment) are connected to the central protrusions 6*c* and the connecting portions 6*d*.

The plurality of ribs 6*e* have a flat plate shape and are formed to stand from the bottom 6*a* and are arranged at equal intervals in the circumferential direction of the shell 2. Among the plurality of ribs 6*e*, a pair of peripheral protrusions 6*f* are formed in each of three of the ribs 6*e*.

The peripheral protrusions 6*f* are formed in pairs in a direction in which the rib 6*e* extends. Female screw holes are formed on upper ends of the pair of peripheral protrusions 6*f*. The pair of peripheral protrusions 6*f* are disposed at three positions in the circumferential direction of the shell 2. The first peripheral sensor 20 to the third peripheral sensor 40 are disposed at the three pairs of peripheral protrusions 6*f*. Accordingly, the first peripheral sensor 20 to the third peripheral sensor 40 are disposed at equal intervals in the circumferential direction of the shell 2.

The central sensor 10 is a sensor configured to detect a strike on the struck surface and is disposed at the center of the frame 6 in a plan view. The central sensor 10 comprises a plate 11, a head sensor 13, and a cushion member 14. The plate 11 is attached to a tip of the central protrusions 6*c*. The head sensor 13 is bonded to the head 3 side of the plate 11 using a double-sided tape 12. The cushion member 14 is bonded to the head 3 side of the head sensor 13.

The plate 11 has a disk shape and is formed of a metallic material. At the outer edge of the plate 11, three fixed portions 11*a* that project toward the outside in the radial direction of the shell 2 are formed. The fixed portion 11*a* is fixed to a tip of the central protrusion 6*c* by a bolt B2.

The head sensor 13 is a disk-shaped sensor configured to detect a strike on the struck surface and comprises a piezoelectric element. The cushion member 14 is a truncated conical cushioning member formed of an elastic material such as sponge, rubber, and a thermoplastic elastomer. The upper end of the cushion member 14 is disposed to abut the film member 3*a*.

The first peripheral sensor 20, the second peripheral sensor 30, and the third peripheral sensor 40 are sensors configured to detect a strike on the struck surface. These sensors are disposed at equal intervals along the circumference centered on the central sensor 10 in a plan view.

Here, the first peripheral sensor 20, the second peripheral sensor 30, and the third peripheral sensor 40 are the same sensor except that disposed positions are different. Therefore, components of the second peripheral sensor 30 and the third peripheral sensor 40 are denoted by the same reference numerals as those of the first peripheral sensor 20, and details thereof will not be described.

The first peripheral sensor 20 (the second peripheral sensor 30 and the third peripheral sensor 40) comprises a plate 21, a head sensor 23, and a cushion member 24. The plate 21 is attached to a tip of a pair of first peripheral protrusions 6*f*. The head sensor 23 is bonded to a surface on the head 3 side of the plate 21 using a double-sided tape 22. The cushion member 24 is bonded to a surface on the head 3 side of the head sensor 23.

The plate 21 has a disk shape and is formed of a metallic material. At the outer edge of the plate 21, two fixed portions 21*a* that project in a direction in which the rib 6*e* extends are formed. The fixed portion 21*a* is fixed to the peripheral protrusion 6*f* by a bolt B3.

The head sensor 23 is a disk-shaped sensor configured to detect a strike on the struck surface and comprises a piezoelectric element. The head sensor 23 is disposed at a position closer to the struck surface than the head sensor 13 of the central sensor 10. That is, an interval between the head sensor 23 and the film member 3*a* is formed to be shorter than an interval between the head sensor 13 and the film member 3*a*.

The cushion member 24 is a truncated conical cushioning member formed of an elastic material such as sponge, rubber, and a thermoplastic elastomer. The cushion member 24 is formed of the same elastic material as the cushion member 14 of the central sensor 10.

The first peripheral sensor 20 to the third peripheral sensor 40 have substantially the same structure as the central sensor 10. That is, the cushion members 14 and 24 abut the film member 3*a* and the head sensors 13 and 23 are disposed on bottom surfaces of the cushion members 14 and 24. Therefore, compared to when the central sensor 10 and the first peripheral sensor 20 to the third peripheral sensor 40 are sensors having different structures, it is possible to reduce manufacturing costs of the electronic drum 1. In addition, there is no need to match characteristics of a strike output of the central sensor 10 and characteristics of strike outputs of the first peripheral sensor 20 to the third peripheral sensor 40. Therefore, the design can be simplified accordingly.

Here, the thickness (a standing height from the head sensor 23) of the cushion member 24 is set to be less (a standing height is lower) than the thickness (a standing height from the head sensor 13) of the cushion member 14. In other words, the cushion member 14 is formed to be thicker than the cushion member 24. That is, the central sensor 10 is disposed at a position further from the struck surface relative to the first peripheral sensor 20 to the third peripheral sensor 40.

Therefore, it is possible to shorten an interval between the head sensor 23 and the struck surface. Accordingly, when a central portion (the vicinity in which the cushion member 14 abuts) of the struck surface is struck, it is possible to shorten a time from when the head sensor 13 detects a strike until the head sensor 23 detects the strike. That is, compared to when cushion members with the same thickness are provided to the central sensor 10 and the first peripheral sensor 20 to the third peripheral sensor 40, it is possible to shorten a time until the head sensor 23 detects the strike. In other words, it is possible to shorten a time until required information such as a signal arrival time and a peak level can be acquired. Therefore, a delay time of sound production control by the control device 7 can be shortened.

In addition, when the central portion of the struck surface is struck, in a peripheral portion (the outside in the radial direction of the shell 2 relative to a central portion in the film member 3*a*), a vibration (an amplitude of the film member 3*a*) of the strike is lower than that of the central portion of the struck surface. Therefore, strike detection sensitivity decreases accordingly.

On the other hand, according to the electronic drum 1 of the present embodiment, the head sensor 23 is disposed at a position closer to the struck surface than the head sensor 13. That is, an interval between the head sensor 23 and the film member 3*a* is formed to be shorter than an interval between the head sensor 13 and the film member 3*a*. Therefore, it is possible to compensate for such a decrease in detection sensitivity.

In addition, the head sensors 13 and 23 are disposed on the back side of the struck surface through the cushion members 14 and 24. Therefore, even if positions directly above the head sensors 13 and 23 are struck, the impact of the strike can be absorbed by the cushion members 14 and 24. Therefore, it is possible to protect the head sensors 13 and 23 from the impact of the strike and prevent damage thereto.

Here, in order to increase strike detection sensitivity, it is preferable that the thicknesses of the cushion members 14 and 24 be reduced and the head sensors 13 and 23 be disposed at positions as close as possible to the struck surface. However, if the thicknesses of the cushion members 14 and 24 are reduced, causing the head sensors 13 and 23 to be disposed too close to the struck surface, a strong hit on the struck surface may compress the cushion members 14 and 24 to an excessive extent and bring the struck surface most close to the head sensors 13 and 23. The situation that the bottom of the struck surface compresses the cushion member to an excessive extent and bring the struck surface most close to the head sensor is called bottoming-out. That is, since it is not possible for the cushion members 14 and 24 to absorb the impact of the strike and the head sensors 13 and 23 are substantially directly hit, the head sensors 13 and 23 may be damaged.

Therefore, the cushion members 14 and 24 are preferably formed with thicknesses such that the struck surface does not bottom out on the head sensors 13 and 23. Thus, the cushion members 14 and 24 are not to be compressed to an excessive extent to cause the struck surface to be most close to the head sensors 13 and 23 when the struck surface is strongly hit. In this case, according to the following procedure, the thicknesses of the cushion members 14 and 24 are set to a thickness such that the struck surface does not bottom out on the head sensors 13 and 23. Thus, the cushion members 14 and 24 are not to be compressed to an excessive extent when the struck surface is strongly hit. First, the vicinity in which the cushion members 14 and 24 abut the struck surface is hit by a stick while the cushion members 14 and 24 are removed, and a maximum amount of deflection of the struck surface (the film member 3*a*) is measured. The amount of deflection varies according to a tension of the struck surface. Therefore, measurement is performed while the struck surface is stretched at the lowest tension within an expected range (a playable range).

In this case, with respect to the maximum amount of deflection of the struck surface when the struck surface is hit, the thicknesses of the cushion members 14 and 24 are preferably set to a thickness of about 1.5 to 2 times the maximum amount of deflection. When the thicknesses of the cushion members 14 and 24 are less than 1.5 times the maximum amount of deflection of the struck surface being strongly hit, the struck surface easily bottoms out on the head sensors 13 and 23, that is to say, the cushion members 14 and 24 are easily to be compressed to an excessive extent to cause the struck surface to be most close to the head sensors 13 and 23. In addition, when the thicknesses of the cushion members 14 and 24 are more than twice the maximum amount of deflection of the struck surface when strongly hit, detection sensitivity of the head sensors 13 and 23 decreases due to the excess thickness.

That is, the thicknesses of the cushion members 14 and 24 are formed as a thickness of about 1.5 to 2 times the maximum amount of deflection of the struck surface when the struck surface is strongly hit. Therefore, it is possible to increase the detection sensitivity while preventing damage to the head sensors 13 and 23.

In the present embodiment, the maximum amount of deflection of the struck surface when strongly hit is 20 mm in the vicinity of the center of the struck surface (the vicinity in which the cushion member 14 abuts) and is 14 mm at the peripheral sides (the vicinity in which the cushion member 24 abuts). Therefore, the thickness of the cushion member 14 is set to 35 mm (1.75 times the maximum amount of deflection of 20 mm) and the thickness of the cushion member 24 is set to 25 mm (1.78 times the maximum amount of deflection of 14 mm). Therefore, even if the struck surface is strongly hit, it is possible to prevent the struck surface to bottom out on the head sensors 13 and 23. Thus, the cushion members 14 and 24 are prevented from being compressed to an excessive extent to cause the struck surface to be most close to the head sensors 13 and 23 and it is possible to increase detection sensitivity of the head sensors 13 and 23.

In this manner, since the struck surface is stretched while a tension is applied to the outer peripheral end, the maximum amount of deflection of the struck surface when struck is large in the vicinity of the center and is smaller on the peripheral sides than in the vicinity of the center. Therefore, according to the maximum amount of deflection, the cushion member 14 is formed to be thicker than the cushion member 24. That is, the cushion member 24 is formed to be thinner than the cushion member 14. Therefore, the head sensor 23 can be disposed at a position close to the struck surface relative to the head sensor 13.

Therefore, the thicknesses of the cushion members 14 and 24 are set according to the amount of deflection of the struck surface when struck. In the present embodiment, the thicknesses of the cushion members 14 and 24 are set to a thickness of about 1.75 times the amount of deflection. Therefore, it is possible to appropriately adjust positions (intervals between the film member 3*a* and the head sensors 13 and 23) at which the head sensors 13 and 23 are disposed relative to the struck surface while protecting the head sensors 13 and 23 with the cushion members 14 and 24.

That is, according to the amount of deflection of the struck surface, heights of the cushion members 14 and 24 are set in advance, and the head sensors 13 and 23 are disposed on bottom surfaces of the cushion members 14 and 24. Accordingly, it is possible to dispose the head sensors 13 and 23 at heights at which detection sensitivity can be increased without causing the struck surface to bottom out on the head sensors 13 and 23. Thus, the cushion members 14 and 24 are not compressed to an excessive extent while the struck surface is strongly hit.

In addition, in the present embodiment, when the struck surface is viewed in a plan view, one central sensor 10 is disposed at the center of the struck surface and a plurality of (three) peripheral sensors are disposed at equal intervals along the circumference centered on the central sensor 10. Therefore, when the inside of the circumference on which three peripheral sensors are disposed is struck, it is possible to detect a strike position with respect to the center of the struck surface according to a difference in detection times of strike signals detected by the three peripheral sensors. Here, the detected strike signal comprises a peak, a falling edge or a rising edge of a voltage waveform, which will be described below. Furthermore, according to the detected waveform of the strike signal obtained by the central sensor 10, it is possible to detect a strike position with respect to the center of the struck surface outside the circumference on which the three peripheral sensors are disposed. Therefore, it is possible to appropriately detect a strike position with respect to the center of the struck surface with the central sensor 10 and the three peripheral sensors.

In addition, the thickness of the cushion member 24 is set to a thickness at which a strike signal (a peak to be described below) when the center of the struck surface is struck can be detected within a predetermined time by the head sensor 23. Here, in the present embodiment, the predetermined time is 2 ms after the central sensor 10 detects a strike. 2 ms is a scan time of the central sensor 10 (to be described below). During the scan time, the first peripheral sensor 20 to the third peripheral sensor 40 detect a peak of the strike (that is, detect whether a strike has occurred and a strength thereof). Therefore, from a time difference in peaks detected by the first peripheral sensor 20 to the third peripheral sensor 40, it is possible to detect a strike position in the vicinity of the center of the struck surface. Therefore, compared to when a strike position in the vicinity of the center of the struck surface is detected by the central sensor 10 based on an initial half wave pitch (to be described below), it is possible to detect a strike position in a shorter time.

Next, a control program will be described, wherein with regards to a strike to the electronic drum 1, the program calculates a strike position and a velocity thereof based on sensor output values of the central sensor 10 and the first peripheral sensor 20 to the third peripheral sensor 40 and performs a playing of a drum sound.

Figure 3:
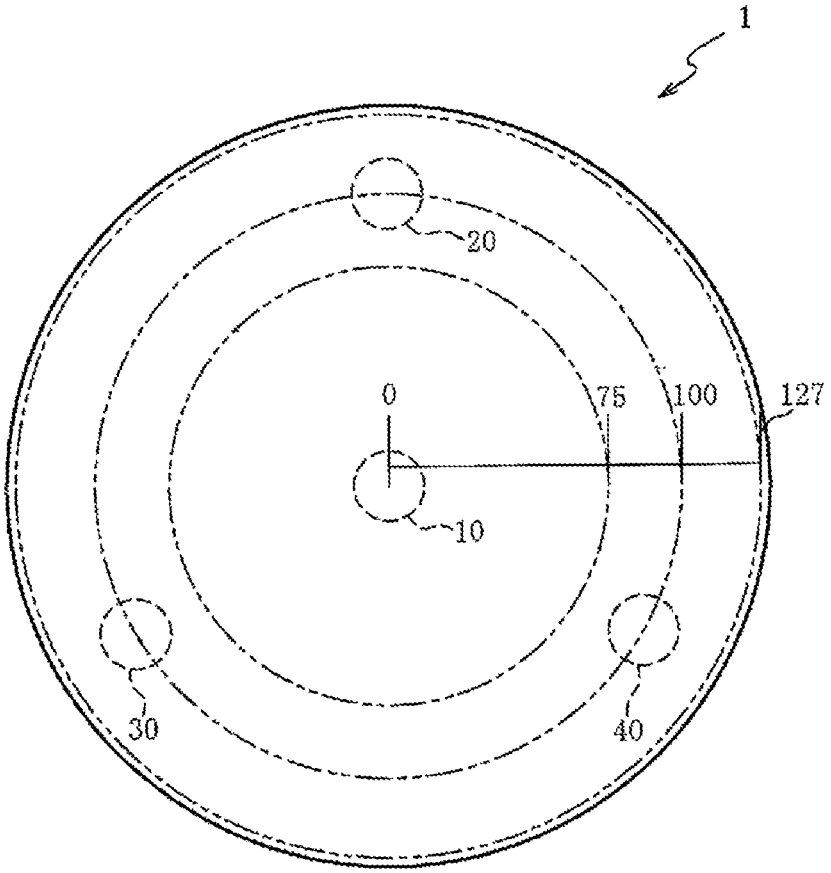
FIG. 3 is a plan view schematically showing arrangement of sensors of the electronic drum.

First, an arrangement of sensors of the electronic drum 1 will be described with reference to FIG. 3. FIG. 3 is a plan view schematically showing a sensor arrangement of the electronic drum 1. When the struck surface of the electronic drum 1 is viewed in a plan view, the struck surface is formed in a circular shape, and the central sensor 10 is disposed at the center of the struck surface. Further, the first peripheral sensor 20 to the third peripheral sensor 40 are disposed at equal intervals along the concentric circumference centered on the central sensor 10. Therefore, in the entire region of the struck surface formed in a circular shape, it is possible to appropriately detect a strike and calculate a velocity thereof. The center of the struck surface has a larger amount of deformation (an amount of deflection) of the struck surface than the peripheral portions of the struck surface. Therefore, the central sensor 10 disposed at the center of the struck surface has a wider range for the sensor output value with respect to a strike and more favorable strike detection sensitivity than the first peripheral sensor 20 to the third peripheral sensor 40 disposed at the peripheral portions of the struck surface.

Here, the first peripheral sensor 20 to the third peripheral sensor 40 are disposed at positions at which the following conditions are satisfied. Here, a waiting process of 2 ms after the central sensor 10 detects a strike will be referred below to as a "scan time of the central sensor 10." During the scan time of the central sensor 10, a maximum value (hereinafter referred to as a "peak") of absolute values of sensor output values according to the same strike can be detected by all of the first peripheral sensor 20 to the third peripheral sensor 40. Also, after the central sensor 10 detects a strike, during the scan time of the central sensor 10, a waveform of a first negative value in the strike according to sensor output values of the central sensor 10, that is, an initial half wave, can be detected. Specifically, the first peripheral sensor 20 to the third peripheral sensor 40 are disposed at positions of "100" in FIG. 3.

In the present embodiment, a strike position in the vicinity of the center of the struck surface is detected using sensor output values of the first peripheral sensor 20 to the third peripheral sensor 40. Further, other strike positions are detected using the sensor output values of the central sensor 10 and the sensor output values of the first peripheral sensor 20 to the third peripheral sensor 40. As will be described below, detection of a strike position for the central sensor 10 is performed by calculating a waveform of a first negative value in the strike according to the sensor output values of the central sensor 10, that is, a magnitude of a pitch of the initial half wave. On the other hand, detection of a strike position for the first peripheral sensor 20 to the third peripheral sensor 40 is performed by calculating a time difference for detecting peaks of the first peripheral sensor 20 and the second peripheral sensor 30 and a time difference for detecting peaks of the first peripheral sensor 20 and the third peripheral sensor 40.

During the scan time of the central sensor 10, when the initial half wave in the central sensor 10 is completely detected and peaks of the first peripheral sensor 20 to the third peripheral sensor 40 according to the same strike are detected, a strike position is calculated by weighted computation of the strike position calculated by the central sensor 10 and the strike position calculated by the first peripheral sensor 20 to the third peripheral sensor 40.

On the other hand, when the vicinity of the center of the struck surface, that is, the vicinity of the central sensor 10 (inside of a circumference at a position of "75" in FIG. 3), is struck, a pitch of the initial half wave detected by the central sensor 10 is large. Therefore, the pitch of the initial half wave detected by the central sensor 10 may not be within the scan time of the central sensor 10. Thus, the region of the strike position which can be calculated based on the pitch of the initial half wave detected by the central sensor 10 within a predetermined time after the center sensor 10 detects the strike excludes the vicinity of the center portion of the struck surface. At that time, it is not possible to accurately detect a strike position for the central sensor 10. On the other hand, detection of a strike position for the first peripheral sensor 20 to the third peripheral sensor 40 is performed by calculating a time difference for detecting peaks of the first peripheral sensor 20 and the second peripheral sensor 30 and a time difference for detecting peaks of the first peripheral sensor 20 and the third peripheral sensor 40. The first peripheral sensor 20 to the third peripheral sensor 40 are disposed at positions at which a peak can be detected within the scan time of the central sensor 10 after the central sensor 10 detects a strike. Therefore, even when the vicinity of the central sensor 10 is struck, within the scan time of the central sensor 10, it is possible to detect a strike position for the first peripheral sensor 20 to the third peripheral sensor 40. Therefore, when it is determined that a strike position detected by the first peripheral sensor 20 to the third peripheral sensor 40 is the vicinity of the central sensor 10, a strike position is calculated using only the strike position detected by the first peripheral sensor 20 to the third peripheral sensor 40. On the other hand, the further the distance from the central sensor 10 to the peripheral sensors 20~40 is, the longer the time from detecting the strike by the central sensor 10 to detecting the strike by the peripheral sensors 20~40 becomes. That is to say, the region of the strike which can be detected by the peripheral sensors 20~40 within a predetermined time after the central sensor 10 detects the strike is limited within the vicinity of the center of the struck surface. If the region of the strike position which can be calculated based on the detection result of the central sensor 10, and the region of the strike position which can be calculated based on the detection result of the peripheral sensors 20~40 do not overlap with each other, some strike positions will not be calculated within a predetermined time after the central sensor 10 detects the strike. Thus, the peripheral sensors 20~40 are disposed in a region of the strike which can be detected by the peripheral sensors 20~40 within a predetermined time after the central sensor 10 detects the strike, and also in a region of the strike, wherein the initial half wave of the strike can be detected by the central sensor 10 within a predetermined time after the central sensor 10 detects the strike.

In addition, calculation of a strike strength (a velocity) is performed by weighted computation of a peak of the central sensor 10 and peaks of the first peripheral sensor 20 to the third peripheral sensor 40 detected according to a strike. As will be described below, within the scan time of the central sensor 10, when a strike is detected by the central sensor 10 and the first peripheral sensor 20 to the third peripheral sensor 40, a velocity is calculated from the peak of the central sensor 10 and the peaks of the first peripheral sensor 20 to the third peripheral sensor 40. Therefore, the velocity is calculated from the central sensor 10 having high strike sensitivity and the first peripheral sensor 20 to the third peripheral sensor 40. Therefore, the velocity can be calculated more accurately.

On the other hand, when the central sensor 10 does not detect a strike in a waiting process of 2 ms (hereinafter referred to as "a scan time of a peripheral sensor") after the first peripheral sensor 20 to the third peripheral sensor 40 detect a strike, the velocity is calculated from the peaks of the first peripheral sensor 20 to the third peripheral sensor 40. Therefore, even if a weak strike is performed at an outer peripheral portion of the struck surface so that it is difficult for the central sensor 10 to detect the strike, the velocity is reliably calculated, and an instruction for generating a musical sound is issued based on the velocity.

Here, in the present embodiment, a position of the center of the struck surface is set to "0" and a position of the outermost periphery in the struck surface is set to "127." In addition, the first peripheral sensor 20 to the third peripheral sensor 40 are disposed at positions of "100" at equal intervals. That is, the first peripheral sensor 20 to the third peripheral sensor 40 are arranged at positions of vertexes of an equilateral triangle. In addition, a threshold value for determining whether calculation of a strike position is performed using only a strike position detected by the first peripheral sensor 20 to the third peripheral sensor 40 is set to a position of "75."

Next, an electrical configuration of the electronic drum 1 will be described with reference to FIG. 4. FIG. 4 is a block diagram showing the electrical configuration of the electronic drum 1. The electronic drum 1 comprises the control device 7 for controlling components of the electronic drum 1. The control device 7 comprises a CPU 71, a ROM 72, and a RAM 73, which are connected via a bus line 74. In addition, the central sensor 10, the first peripheral sensor 20, the second peripheral sensor 30, the third peripheral sensor 40, and an external input and output terminal 75 are connected to the bus line 74. The sound source 76 or a test PC 79 is connected to the external input and output terminal 75. In FIG. 4, for explanation, a state in which both the sound source 76 and the test PC 79 are connected is shown. The amplifier 77 is connected to the sound source 76. The speaker 78 is connected to the amplifier 77.

The CPU 71 is an arithmetic device for controlling components connected via the bus line 74. The ROM 72 is a non-rewritable memory. In the ROM 72, a control program 72*a*, a central sensor strike position table 72*b*, and a peripheral sensor strike position table 72*c* are stored. When the control program 72*a* is executed by the CPU 71, an initialization process (FIG. 7(*a*)) is performed. The central sensor strike position table 72*b* is a table for acquiring a strike position of the electronic drum 1 from a pitch ΔThw of the initial half wave according to an output value of a strike with respect to the central sensor 10. Here, the pitch ΔThw of the initial half wave will be described with reference to FIG. 6(*a*).

Figure 6A:
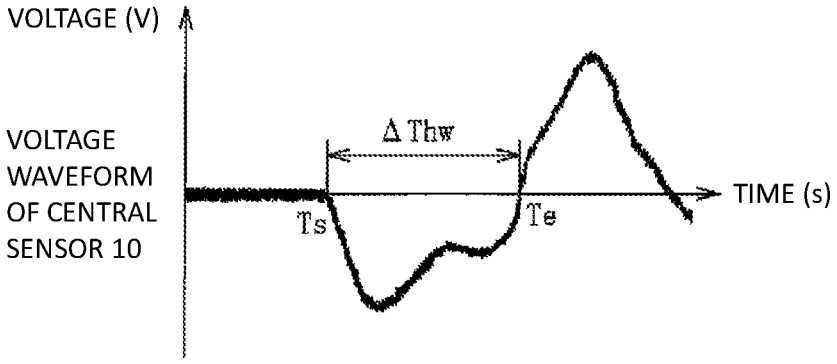
FIG. 6(*a*) is a voltage and time graph of a voltage waveform (an output waveform from a central sensor) based on a strike in a central sensor.
Figure 6B:
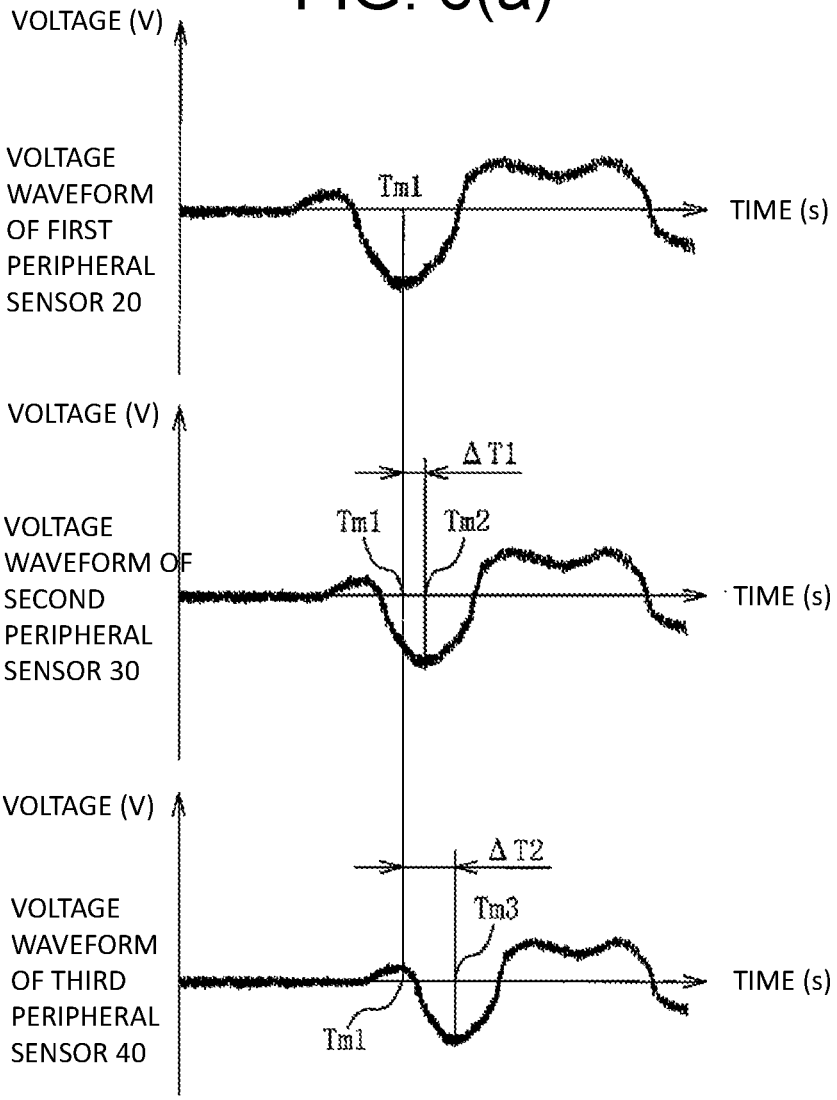

FIG. 6(*a*) is a voltage and time graph of a voltage waveform (an output waveform from the central sensor 10) based on a strike in the central sensor 10. The vertical axis represents the voltage and the horizontal axis represents the time. A voltage waveform between a time Ts at which a voltage waveform starts based on the strike output from the central sensor 10 and a time Te which is a zero cross point of the voltage waveform immediately thereafter has a negative value. This is because, when the struck surface of the electronic drum is struck, the struck surface "deflects" in a negative direction. In the present embodiment, a voltage waveform with a negative value output from the time Ts at which detection of the strike starts to the time Te is referred to as an "initial half wave." In general, there are characteristics in which the pitch ΔThw of the initial half wave detected by the central sensor 10, that is, a time difference between the time Te and the time Ts, varies according to the distance between the central sensor 10 and the strike position. Specifically, there are characteristics in which the pitch ΔThw of the initial half wave becomes larger as the strike position becomes closer to the central sensor 10 and the pitch ΔThw of the initial half wave becomes smaller as the strike position becomes further away from the central sensor 10. This relationship is calculated from measured values and tabulated in the central sensor strike position table 72*b*. The central sensor strike position table 72*b* will be described with reference to FIG. 5(*a*).

FIG. 5(*a*) is a diagram schematically showing the central sensor strike position table 72*b*. The central sensor strike position table 72*b* is a table in which strike positions calculated from the measured values according to the pitch ΔThw of the initial half wave are stored. The pitch ΔThw of the initial half wave calculated from the voltage waveform based on the strike in the central sensor 10 is referred to as the pitch ΔThw of the initial half wave of the central sensor strike position table 72*b* and the corresponding strike position is acquired. Using the acquired strike position and the strike position obtained from the first peripheral sensor 20 to the third peripheral sensor 40 (to be described below), the strike position is calculated and performance information of the electronic drum 1 is generated based on the calculated result. Here, in FIG. 5(*a*), numerical values of the central sensor strike position table 72*b* are not necessarily limited thereto. According to materials and characteristics of the head 3, the central sensor 10, and the cushion member 14, the arrangement of the central sensor 10, the height of the cushion member 14, and the like, numerical values of the central sensor strike position table 72*b* may be appropriately set.

Returning to FIG. 4, the peripheral sensor strike position table 72*c* is a table in which the strike position of the electronic drum 1 is acquired according to strike detection time differences between the first peripheral sensor 20 to the third peripheral sensor 40. Here, the strike detection time differences between the first peripheral sensor 20 to the third peripheral sensor 40 will be described with reference to FIG. 6(*b*).

FIG. 6(*b*) is a voltage and time graph of voltage waveforms in the first peripheral sensor 20, the second peripheral sensor 30, and the third peripheral sensor 40 which are detected with respect to a certain strike on the struck surface of the electronic drum 1. The vertical axis represents the voltage and the horizontal axis represents the time. A time at which the peak due to a certain strike is detected by the first peripheral sensor 20 is set as a peak time Tm1. Further, times at which peaks due to the same strike are detected by the second peripheral sensor 30 and the third peripheral sensor 40 are set as a peak time Tm2 and a peak time Tm3. In addition, a time difference between the peak time Tm1 and the peak time Tm2 is set as ΔT1, and a time difference between the peak time Tm1 and the peak time Tm3 is set as ΔT2. The first peripheral sensor 20, the second peripheral sensor 30, and the third peripheral sensor 40 are disposed at equal intervals at positions of "100" from the center of the struck surface (refer to FIG. 3). Therefore, when the center of the struck surface is struck, the detected peak times Tm1, Tm2, and Tm3 are the same. On the other hand, when a portion other than the center of the struck surface is struck, the detected peak times Tm1, Tm2, and Tm3 vary according to the strike position. That is, ΔT1 and ΔT2 vary according to the strike position. Here, in the present embodiment, using the first peripheral sensor 20 as a base point for the peripheral sensors, according to the time differences ΔT1 and ΔT2 of the peak of the strike between the first peripheral sensor 20, and the second peripheral sensor 30 and the third peripheral sensor 40, the strike position is calculated from the measured values. The calculated values are tabulated in the peripheral sensor strike position table 72*c*. The peripheral sensor strike position table 72*c* will be described with reference to FIG. 5(*b*).

FIG. 5(*b*) is a diagram schematically showing the peripheral sensor strike position table 72*c*. The peripheral sensor strike position table 72*c* is a table in which strike positions calculated from the measured values according to the time differences ΔT1 and ΔT2 of the peak of the strike between the first peripheral sensor 20, and the second peripheral sensor 30 and the third peripheral sensor 40 are stored. The time differences ΔT1 and ΔT2 of the peak of the strike are referred to as the time differences ΔT1 and ΔT2 of the peripheral sensor strike position table 72*c* and the corresponding strike position is acquired. Therefore, the strike position for the first peripheral sensor 20 to the third peripheral sensor 40 can be acquired more quickly than when the strike position is calculated from the time differences ΔT1 and ΔT2 of the peak of each strike. Using the acquired strike position and the strike position obtained from the central sensor 10, a strike position is calculated and performance information of the electronic drum 1 is generated based on the calculated result. Here, it is not possible to calculate the strike position according to the time differences ΔT1 and ΔT2 of a peak of a strike on the outer peripheral side relative to positions of the first peripheral sensor 20 to the third peripheral sensor 40. This is because, for example, the time differences ΔT1 and ΔT2 of the peak of the strike when a position (a position A) of the first peripheral sensor 20 is struck have the same value as the time differences ΔT1 and ΔT2 of the peak of the strike when a position on the outer peripheral side of the first peripheral sensor 20 along an extension line connecting the position A and the center of the struck surface is struck. Therefore, in the peripheral sensor strike position table 72*c* also, according to the time differences ΔT1 and ΔT2, at a storage position when a position is on the outer peripheral side relative to the first peripheral sensor 20 to the third peripheral sensor 40, the same "100" as in the positions of the first peripheral sensor 20 to the third peripheral sensor 40 is stored.

Here, in FIG. 5(*b*), numerical values of the peripheral sensor strike position table 72*c* are not necessarily limited thereto. According to materials and characteristics of the head 3, the first peripheral sensor 20 to the third peripheral sensor 40, and the cushion member 24, and an arrangement of the first peripheral sensor 20 to the third peripheral sensor 40, and the height of the cushion member 24, and the like, numerical values of the peripheral sensor strike position table 72*c* are appropriately set.

In addition, in FIG. 5(*b*), in the peripheral sensor strike position table 72*c*, strike positions are calculated based on absolute values of the time differences ΔT1 and ΔT2. However, the strike positions may be calculated by including positive and negative signs of the time differences ΔT1 and ΔT2. That is, the calculated strike positions (distances from the central sensor 10) may be different according to the positive and negative signs of the time differences ΔT1 and ΔT2 of the peak of the strike.

Returning to FIG. 4, the RAM 73 is a rewritable memory in which various types of work data, flags, and the like used when the CPU 71 executes a program such as the control program 72*a* can be stored. In the RAM 73, a sensor value memory 73*a*, a sensor value ring buffer 73*b*, a sensor peak value memory 73*c*, a central sensor scan flag 73*d*, a peripheral sensor scan flag 73*e*, a central sensor strike position gain memory 73*f*, a central sensor strike position memory 73*g*, a peripheral sensor strike position memory 73*h*, a strike position memory 73*i*, a velocity memory 73*j*, and a test mode flag 73*k* are provided.

Figure 7B:
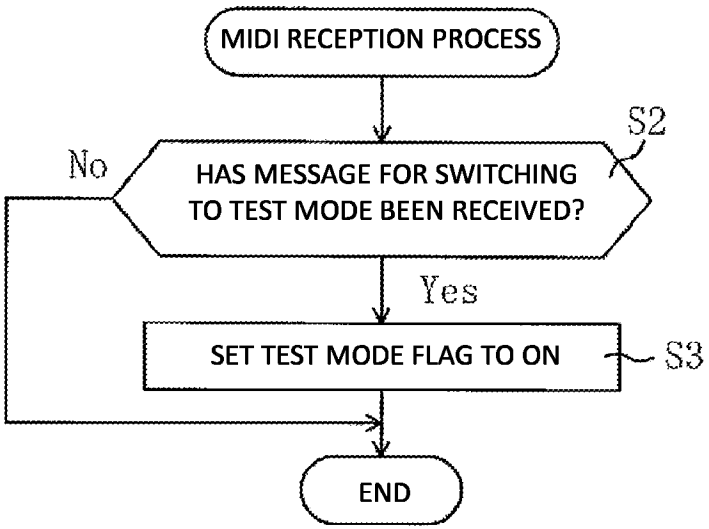
FIG. 7(*a*) is a flowchart of an initialization process.
Figure 7A:
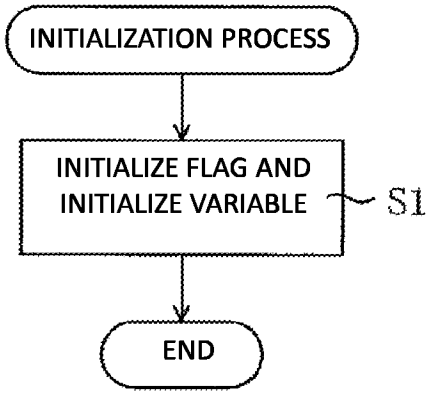
Figure 8:
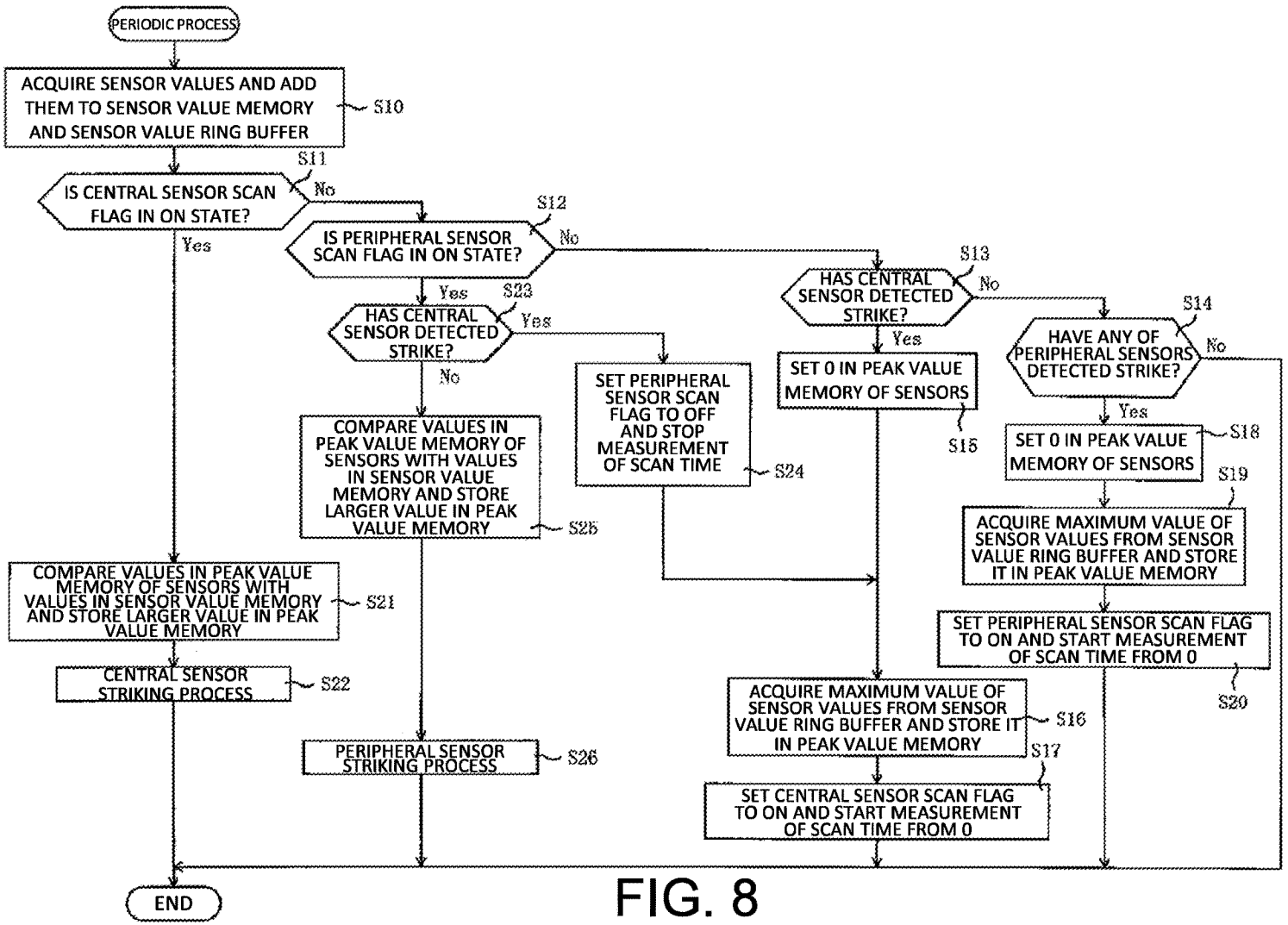
FIG. 8 is a flowchart of a periodic process.

The sensor value memory 73*a* is a memory in which A/D converted sensor output values of the central sensor 10 and the first peripheral sensor 20 to the third peripheral sensor 40 (with no unit) are stored. Although not shown, in the sensor value memory 73*a*, sensor output values of the central sensor 10 and the first peripheral sensor 20 to the third peripheral sensor 40 are stored separately. The values in the sensor value memory 73*a* are initialized to "0" when the electronic drum 1 is powered on and immediately after the initialization process in FIG. 7(*a*) is performed. Then, in a periodic process in FIG. 8, sensor output values of the central sensor 10 and the first peripheral sensor 20 to the third peripheral sensor 40 are stored in the corresponding sensor value memory 73*a* when the periodic process is performed (FIG. 8, S10).

The sensor value ring buffer 73*b* is a buffer in which values for the past 5 ms of A/D converted sensor output values of the central sensor 10 and the first peripheral sensor 20 to the third peripheral sensor 40 are stored. The sensor value ring buffer 73*b* will be described with reference to FIG. 5(*c*).

FIG. 5(*c*) is a diagram schematically showing the sensor value ring buffer 73*b*. The sensor value ring buffer 73*b* comprises a central sensor value memory 73*b*1, a first peripheral sensor value memory 73*b*2, a second peripheral sensor value memory 73*b*3, and a third peripheral sensor value memory 73*b*4. Each of the sensor output values of the sensors is stored in the corresponding memory. The central sensor value memory 73*b*1 is a memory in which A/D converted sensor output values of the central sensor 10 (with no unit) are stored. The first peripheral sensor value memory 73*b*2 to the third peripheral sensor value memory 73*b*4 are memories in which A/D converted sensor output values (with no unit) of the first peripheral sensor 20 to the third peripheral sensor 40 are stored. The central sensor value memory 73*b* and the first peripheral sensor value memory 73*b*2 to the third peripheral sensor value memory 73*b*4 are initialized to "0" when the electronic drum 1 is powered on and immediately after the initialization process in FIG. 7(*a*) is performed. Then, in the periodic process in FIG. 8, sensor output values of the central sensor 10 and the first peripheral sensor 20 to the third peripheral sensor 40 are added to the corresponding central sensor value memory 73*b*1 and first peripheral sensor value memory 73*b*2 to third peripheral sensor value memory 73*b*4 when the periodic process is performed (FIG. 8, S10).

In the sensor value ring buffer 73*b*, a memory in which 50 sensor output values are stored is provided. This is because, the periodic process (to be described below) in FIG. 8 is performed every 100 microseconds (hereinafter referred to as "s") and sensor output values for the past 5 ms are stored. In the sensor value ring buffer 73*b*, first, acquired sensor output values are stored in the order of Nos. 1 to 50. Then, when a sensor output value is stored in No. 50, after that the sensor output values are stored in order from No. 1 again. Therefore, in the sensor value ring buffer 73*b*, sensor output values for the past 5 ms at maximum are stored. Using values in the sensor value ring buffer 73*b*, peaks of the sensor output values are acquired and the pitch ΔThw of the initial half wave of the central sensor 10 is acquired.

Figure 9:
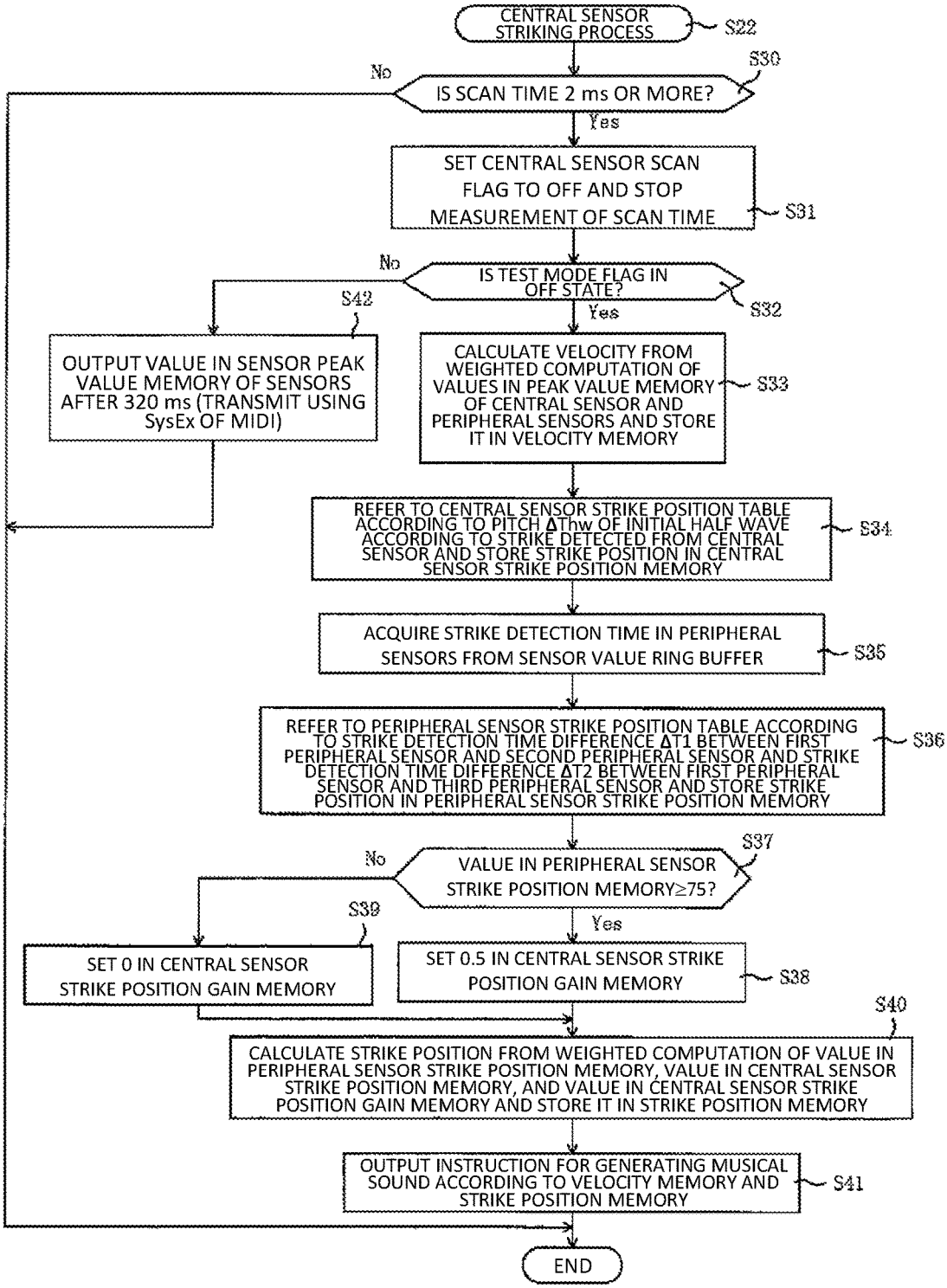
FIG. 9 is a flowchart of a central sensor striking process.
Figure 10:
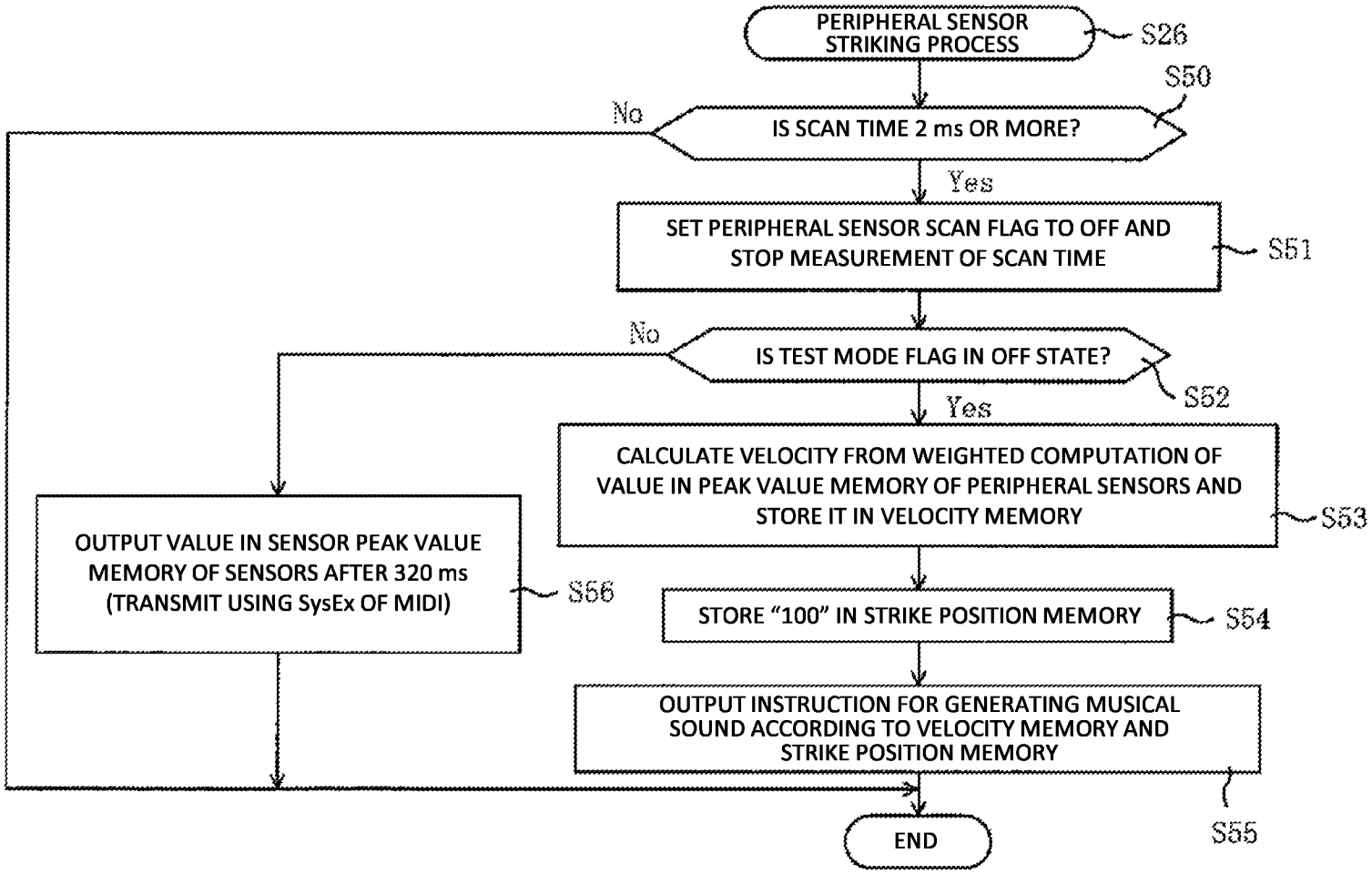
FIG. 10 is a flowchart of a peripheral sensor striking process.

Returning to FIG. 4, the sensor peak value memory 73*c* is a memory in which peaks (maximum absolute values) of the sensor output values of the central sensor 10 and the first peripheral sensor 20 to the third peripheral sensor 40 are stored. Although not shown, in the sensor peak value memory 73*c*, peaks of sensor output values of the central sensor 10 and the first peripheral sensor 20 to the third peripheral sensor 40 are stored separately. The values of the sensor peak value memory 73*c* are initialized to "0" when the electronic drum 1 is powered on and immediately after the initialization process in FIG. 7(*a*) is performed. Then, in the periodic process in FIG. 8, when a strike is detected by the central sensor 10 and the first peripheral sensor 20 to the third peripheral sensor 40, peaks of sensor output values of the central sensor 10 and the first peripheral sensor 20 to the third peripheral sensor 40 from the sensor value ring buffer 73*b* are stored in the sensor peak value memory 73*c* (FIG. 8, S16, S19). Then, values in the sensor value memory 73*a* of the central sensor 10 and the first peripheral sensor 20 to the third peripheral sensor 40 are compared with values in the corresponding sensor peak value memory 73*c*, and larger values are stored in the sensor peak value memory 73*c* (FIG. 8, S21, S25). By weighted computation of values in the sensor peak value memory 73*c* of the central sensor 10 and the first peripheral sensor 20 to the third peripheral sensor 40, a velocity according to the strike is calculated (FIG. 9, S33, FIG. 10, S53).

The central sensor scan flag 73*d* is a flag indicating that the time is within the scan time of the central sensor 10 that is a waiting process of 2 ms. When the electronic drum 1 is powered on and immediately after the initialization process in FIG. 7(*a*) is performed, the central sensor scan flag 73*d* is set to off, which indicates that the time is not within the scan time of the central sensor 10. Then, in the periodic process in FIG. 8, when it is determined that a strike is detected in the central sensor 10, the central sensor scan flag 73*d* is set to on (FIG. 8, S17). Then, in a central sensor striking process in FIG. 9, when the scan time of the central sensor 10 ends, the central sensor scan flag 73*d* is set to off (FIG. 9, S31).

The peripheral sensor scan flag 73*e* is a flag indicating that the time is within the scan time of the peripheral sensor that is a waiting process of 2 ms. When the electronic drum 1 is powered on and immediately after the initialization process in FIG. 7(*a*) is performed, the peripheral sensor scan flag 73*e* is set to off, which indicates that the time is not within the scan time of the peripheral sensor. Then, in the periodic process in FIG. 8, when it is determined that a strike is detected in any of the first peripheral sensor 20 to the third peripheral sensor 40, the peripheral sensor scan flag 73*e* is set to on (FIG. 8, S20). Then, in a peripheral sensor striking process in FIG. 10, when the scan time of the first peripheral sensor 20 to the third peripheral sensor 40 ends, the peripheral sensor scan flag 73*e* is set to off (FIG. 10, S51). In addition, while the peripheral sensor scan flag 73*e* is in an on state, when a strike is detected by the central sensor 10, the peripheral sensor scan flag 73*e* is set to off (FIG. 8, S24). As will be described below, this is because, within the scan time of the peripheral sensor, when a strike is detected by the central sensor 10, the scan time of the peripheral sensor is stopped and the scan time of the central sensor 10 starts again. Then, after the scan time of the central sensor 10, a strike position and a velocity are calculated according to the central sensor 10 and the first peripheral sensor 20 to the third peripheral sensor 40.

The central sensor strike position gain memory 73*f* is a memory in which weight coefficients with respect to strike positions for the central sensor 10, which are used when the strike position is calculated, are stored. The central sensor strike position gain memory 73*f* is initialized to "0" when the electronic drum 1 is powered on and immediately after the initialization process in FIG. 7(*a*) is performed. Then, in the central sensor striking process in FIG. 9, when the strike position for the first peripheral sensor 20 to the third peripheral sensor 40 is "75" or more, "0.5" is set in the central sensor strike position gain memory 73*f*. Here, "75" is a threshold value indicating whether the strike position is calculated based on only strike positions detected by the first peripheral sensor 20 to the third peripheral sensor 40. On the other hand, when the strike position for the first peripheral sensor 20 to the third peripheral sensor 40 is smaller than "75," "0" is set in the central sensor strike position gain memory 73*f* (FIG. 9, S38, S39). Then, values in the central sensor strike position gain memory 73*f* are used as weight coefficients for the strike position for the central sensor 10 (that is, values in the central sensor strike position memory 73*g* to be described below). Then, the strike position is calculated by combining a value obtained by multiplying a strike position for the central sensor 10 by a weight coefficient and a strike position for the first peripheral sensor 20 to the third peripheral sensor 40 (that is, a value of the peripheral sensor strike position memory 73*h*).

The central sensor strike position memory 73*g* is a memory in which the strike position acquired by the central sensor 10 is stored. The central sensor strike position memory 73*g* is initialized to "0" when the electronic drum 1 is powered on and immediately after the initialization process in FIG. 7(*a*) is performed. Then, in the central sensor striking process in FIG. 9, the central sensor strike position table 72*b* is referred to according to the calculated pitch ΔThw of the initial half wave of the central sensor 10 from the sensor value ring buffer 73*b*, and the acquired strike position is stored in the central sensor strike position memory 73*g* (FIG. 9, S34).

The peripheral sensor strike position memory 73*h* is a memory in which the strike positions acquired by the first peripheral sensor 20 to the third peripheral sensor 40 are stored. The peripheral sensor strike position memory 73*h* is initialized to "0" when the electronic drum 1 is powered on and immediately after the initialization process in FIG. 7(*a*) is performed. Then, the peripheral sensor strike position table 72*c* is referred to according to the calculated time difference ΔT1 between peaks of the first peripheral sensor 20 and the second peripheral sensor 30 and time difference ΔT2 between peaks of the first peripheral sensor 20 and the third peripheral sensor 40 from the sensor value ring buffer 73*b*. As a result, the acquired strike position is stored in the peripheral sensor strike position memory 73*h* (FIG. 9, S36).

The strike position memory 73*i* is a memory in which strike positions calculated based on detection results of the strike on the struck surface of the electronic drum 1 are stored. The strike position memory 73*i* is initialized to "0" when the electronic drum 1 is powered on and immediately after the initialization process in FIG. 7(*a*) is performed. When the central sensor 10 detects a strike, after the scan time of the central sensor 10, a strike position is calculated based on the strike position for the central sensor 10 and the strike position for the first peripheral sensor 20 to the third peripheral sensor 40 (FIG. 9, S40).

On the other hand, when the first peripheral sensor 20 to the third peripheral sensor 40 detect a strike and the central sensor 10 does not detect a strike within the scan time of the peripheral sensor, "100" is stored in the strike position memory 73*i*. That is, while the central sensor 10 does not detect a strike such as a case in which the outer peripheral portion of the struck surface is weakly struck, when the first peripheral sensor 20 to the third peripheral sensor 40 detect a strike, it is assumed that the strike occurs at a position of the first peripheral sensor 20 to the third peripheral sensor 40 (FIG. 10, S54), and an instruction for generating a musical sound is issued based on the strike position. Therefore, it is possible to issue the instruction for generating a musical sound according to a weak strike on the outer peripheral portion of the struck surface, and the instruction for generating a musical sound is not delayed. Here, when the central sensor 10 does not detect a strike, a value stored in the strike position memory 73*i* is not necessarily limited to "100" and any value in the range of "100" to "127" may be stored.

The velocity memory 73*j* is a memory in which velocities (strike strengths) calculated based on detection results of a strike on the struck surface of the electronic drum 1 are stored. The velocity memory 73*j* is initialized to "0" when the electronic drum 1 is powered on and immediately after the initialization process in FIG. 7(*a*) is performed. In the central sensor striking process in FIG. 9, from weighted computation of peaks of the sensor output values of the central sensor 10 and the first peripheral sensor 20 to the third peripheral sensor 40 stored in the sensor peak value memory 73*c*, the calculated velocity is stored in the velocity memory 73*j* (FIG. 9, S33). In addition, in the peripheral sensor striking process in FIG. 10, from weighted computation of peaks of the sensor output values of the first peripheral sensor 20 to the third peripheral sensor 40 stored in the sensor peak value memory 73*c*, the calculated velocity is stored in the velocity memory 73*j* (FIG. 10, S55). Then, the instruction for generating a musical sound according to a value in the velocity memory 73*j* and a value in the strike position memory 73*i* is issued to the sound source 76 (to be described below) (FIG. 9, S41, FIG. 10, S55).

The test mode flag 73*k* is a flag indicating that the electronic drum 1 is in a test mode. When the electronic drum 1 is powered on and immediately after the initialization process in FIG. 7(*a*) is performed, the test mode flag 73*k* is set to off, which indicates the mode is not the test mode. In a MIDI reception process in FIG. 7(*b*), when a message for switching to the test mode is received, the test mode flag 73*k* is set to on (FIG. 7(*b*), S3). In the present embodiment, when the central sensor 10 or the first peripheral sensor 20 to the third peripheral sensor 40 detects a strike, after 320 ms, the electronic drum 1 in the test mode transmits a MIDI System Exclusive Message including the detected sensor output values, which are, values in the sensor peak value memory 73*c*, through the external input and output terminal 75 (to be described below). A MIDI system Exclusive Message will be referred to as "SysEx" below. The test PC 79 (to be described below) connected to the external input and output terminal 75 analyzes the received SysEx message and determines whether the sensors are operating normally based on the sensor output values of the central sensor 10 and the first peripheral sensor 20 to the third peripheral sensor 40 comprised in the message.

The external input and output terminal 75 is an interface for transmitting and receiving data between the electronic drum 1 and the sound source 76, the test PC 79, and another computer. The sound source 76 and the test PC 79 will be described below. The instruction for generating a musical sound generated by the electronic drum 1 is transmitted to the sound source 76 through the external input and output terminal 75. In addition, the SysEx message including values in the sensor peak value memory 73*c* is transmitted to the test PC 79 through the external input and output terminal 75. In addition, the SysEx message from the test PC 79 is received through the external input and output terminal 75.

The sound source 76 is a device configured to control tones of a musical sound (a striking sound) and various effects according to an instruction from the CPU 71. A digital signal processor (DSP) 76*a* configured to perform computation processes such as filtering and effects on waveform data is built into the sound source 76. The musical sound processed by the sound source 76 is output as an analog musical sound signal.

The amplifier 77 is a device configured to amplify the analog musical sound signal output from the sound source 76 and output the amplified analog musical sound signal to the speaker 78. The speaker 78 produces (outputs) the analog musical sound signal amplified by the amplifier 77 as a musical sound.

The test PC 79 is a computer for analyzing the sensor output values of the central sensor 10 and the first peripheral sensor 20 to the third peripheral sensor 40 comprised in the SysEx message received from the electronic drum 1 in the test mode. The test PC 79 transmits the SysEx message including the message for switching to the test mode to the electronic drum 1 through the external input and output terminal 75. When the message for switching to the test mode is received, the electronic drum 1 transitions to the test mode. Then, when the electronic drum 1 detects a strike, after 320 ms, a SysEx message including values in the sensor peak value memory 73*c* is transmitted to the test PC 79. Then, the test PC 79 analyzes the received SysEx message including values in the sensor peak value memory 73*c* using an inspection fixture application that the test PC 79 executes. Then, it is determined whether the central sensor 10 and the first peripheral sensor 20 to the third peripheral sensor 40 are operating normally.

The initialization process performed in the CPU 71 of the electronic drum 1 will be described with reference to FIG. 7(*a*). FIG. 7(*a*) is a flowchart of the initialization process. The initialization process is performed immediately after the electronic drum 1 is powered on and memory values and flags in the RAM 73 are initialized (S1).

Next, the MIDI reception process performed in the CPU 71 of the electronic drum 1 will be described with reference to FIG. 7(*b*). The MIDI reception process is performed according to an interrupt process that is performed with the reception of MIDI data as a trigger through the external input and output terminal 75.

FIG. 7(*b*) is a flowchart of the MIDI reception process. In the MIDI reception process, first, the received MIDI data is analyzed and it is checked whether the result is a message for switching to the test mode (S2). When the received MIDI data is the message for switching to the test mode (Yes in S2), the test mode flag 73*k* is set to on (S3). On the other hand, when the received MIDI data is not the message for switching to the test mode (No in S2), the process of S3 is skipped. After the processes of S2 and S3, the MIDI reception process ends. Therefore, when the MIDI data received from the test PC 79 is the message for switching to the test mode, the electronic drum 1 transitions to the test mode. Then, when the electronic drum 1 detects a strike, after 320 ms, the electronic drum 1 transmits the SysEx message including values in the sensor peak value memory 73*c* to the test PC 79. Here, the test mode flag 73*k* which has been set to on continues to be in an on state until the electronic drum 1 is powered off. The test mode flag 73*k* is set to off in the process of S1 in FIG. 7(*a*) immediately after the electronic drum 1 is powered on next time.

Next, the periodic process performed in the CPU 71 of the electronic drum 1 will be described with reference to FIG. 8 to FIG. 10. In the periodic process, the sensor output values of the central sensor 10 and the first peripheral sensor 20 to the third peripheral sensor 40 when the periodic process is performed are acquired. In addition, in the periodic process, when the scan time has elapsed, the central sensor striking process (FIG. 9) or the peripheral sensor striking process (FIG. 10) in which a strike position and a velocity are calculated and an instruction for generating a musical sound is issued is performed. The periodic process is repeatedly performed every 100 μs according to an interval interrupt process every 100 μs.

FIG. 8 is a flowchart of the periodic process. In the periodic process, first, the sensor output values of the central sensor 10 and the first peripheral sensor 20 to the third peripheral sensor 40 are acquired. Then, the acquired sensor output value is stored in the sensor value memory 73*a* and is added to the sensor value ring buffer 73*b* (S10). In the sensor value ring buffer 73*b*, No. 1 in FIG. 5(*c*) indicates a first storage position of a sensor output value. Thereafter, the storage position moves in ascending order of No. 2, No. 3 . . . , and the sensor output values are stored in these areas. When values up to No. 50 have been stored, a value is stored in No. 1 again. Here, since the periodic process is performed every 100 μs, values in the sensor value memory 73*a* and values in the sensor value ring buffer 73*b* are updated every 100 μs.

After the process of S10, it is checked whether the central sensor scan flag 73*d* is in an on state (S11). When the central sensor scan flag 73*d* is in an off state (No in S11), that is, when the time is not within the scan time of the central sensor 10, it is checked whether the peripheral sensor scan flag 73*e* is in an on state (S12).

When the peripheral sensor scan flag 73*e* is in an off state (No in S12), that is, when the time is not within the scan time of the peripheral sensor, it is checked whether the central sensor 10 has detected a strike (S13). Detection of a strike by the central sensor 10 is determined based on whether a falling (or rising) edge has been detected in a voltage waveform according to the sensor value ring buffer 73*b* of the central sensor 10.

When the central sensor 10 has detected a strike (Yes in S13), 0 is set in the sensor peak value memory 73*c* of the central sensor 10 and the first peripheral sensor 20 to the third peripheral sensor 40 (S15). In the sensor peak value memory 73*c*, a sensor output value peak stored previously may be stored. Therefore, when the central sensor 10 has detected a strike, the values in the sensor peak value memory 73*c* are initialized to "0."

After the process of S15, from values in the sensor value ring buffer 73*b*, a peak in the sensor peak value memory 73*c* of the central sensor 10 and the first peripheral sensor 20 to the third peripheral sensor 40 is acquired. Then, the acquired peak is stored in the sensor peak value memory 73*c* of the corresponding sensor (S16).

After the process of S16, the central sensor scan flag 73*d* is set to on and measurement of the scan time starts from 0 (S17). Thereafter, the scan time is measured whenever the periodic process is performed. Therefore, measurement of "the scan time of the central sensor 10" starts.

In the process of S13, when the central sensor 10 has not detected a strike (No in S13), it is checked whether any of the first peripheral sensor 20 to the third peripheral sensor 40 has detected a strike (S14). Detection of a strike by the first peripheral sensor 20 to the third peripheral sensor 40 is determined based on whether a falling (or rising) edge has been detected in a voltage waveform according to the sensor value ring buffer 73*b* of any of the first peripheral sensor 20 to the third peripheral sensor 40.

When any of the first peripheral sensor 20 to the third peripheral sensor 40 has detected a strike (Yes in S14), 0 is set in the sensor peak value memory 73*c* of the central sensor 10 and the first peripheral sensor 20 to the third peripheral sensor 40 (S18). Then, from values in the sensor value ring buffer 73*b*, a peak in the sensor peak value memory 73*c* of the central sensor 10 and the first peripheral sensor 20 to the third peripheral sensor 40 is acquired. Then, the acquired peak is stored in the sensor peak value memory 73*c* of the corresponding sensor (S19).

After the process of S19, the peripheral sensor scan flag 73*e* is set to on and measurement of the scan time starts from 0 (S20). Thereafter, the scan time is measured whenever the periodic process is performed. Therefore, measurement of "the scan time of the peripheral sensor" starts.

When the scan time of the central sensor 10 or the scan time of the peripheral sensor starts, peaks of sensors for the last 5 ms stored in the sensor value ring buffer 73*b* are acquired and stored in the sensor peak value memory 73*c*. This is because, when the central sensor 10 or the first peripheral sensor 20 to the third peripheral sensor 40 detect a strike, there is a possibility that a peak of a voltage waveform due to a previous strike detected by any of the first peripheral sensor 20 to the third peripheral sensor 40 or the central sensor 10 has been stored in the sensor peak value memory 73*c*. First, when each scan time starts, a peak is found from values in the sensor value ring buffer 73*b* and the peak is stored in the sensor peak value memory 73*c*. Then, in the processes of S21 and S25 (to be described below), during each scan time, whenever the periodic process is performed, values in the sensor value memory 73*a* in which sensor output values when the periodic process is performed are stored are compared with values in the sensor peak value memory 73*c*, and values having a larger maximum absolute value are stored in the sensor peak value memory 73*c*. Therefore, a peak of the sensor output value before and after the scan time of the central sensor 10 is stored in the sensor peak value memory 73*c*.

On the other hand, when none of the first peripheral sensor 20 to the third peripheral sensor 40 detects a strike (No in S14), the processes of S18 to S20 are skipped.

In the process of S11, when the central sensor scan flag 73*d* is in an on state (Yes in S11), absolute values of values in the sensor peak value memory 73*c* of the central sensor 10 and the first peripheral sensor 20 to the third peripheral sensor 40 are compared with absolute values in the sensor value memory 73*a* of the corresponding sensor. Then, larger values are stored in the sensor peak value memory 73*c* (S21). In the sensor peak value memory 73*c*, in the process of S16 immediately after the central sensor 10 has detected a strike (Yes in S13), values of peaks in the sensor value ring buffer 73*b* of the sensors are stored. There is a possibility that at a timing thereafter, values of peaks are detected from the sensors. Therefore, while the central sensor scan flag 73*d* is in an on state, that is, during the scan time of the central sensor 10, absolute values of sensor output values (that is, values in the sensor value memory 73*a*) acquired from the sensors at that time are compared with absolute values of values in the sensor peak value memory 73*c* of the corresponding sensor, and larger values are stored in the sensor peak value memory 73*c*. After the process of S21, the central sensor striking process is performed (S22). The central sensor striking process will be described below with reference to FIG. 9.

In the process of S12, when the peripheral sensor scan flag 73*e* is in an on state (Yes in S12), it is checked whether the central sensor 10 has detected a strike (S23). Here, the method of checking whether the central sensor 10 has detected a strike is the same as in the process of S13. When the central sensor 10 has detected a strike (Yes in S23), the peripheral sensor scan flag 73*e* is set to off, measurement of the scan time is stopped (S24), and the process after S16 is performed. That is, during the scan time of the peripheral sensor, when the central sensor 10 has detected a strike, the scan time of the central sensor 10 starts.

The center of the struck surface has a larger amount of deformation (an amount of deflection) of the struck surface than the peripheral portions of the struck surface. Therefore, the central sensor 10 disposed at the center of the struck surface has a wider range of sensor output values with respect to a strike and more favorable strike detection sensitivity than the first peripheral sensor 20 to the third peripheral sensor 40 disposed at the peripheral portions of the struck surface. Therefore, in cases in which the first peripheral sensor 20 to the third peripheral sensor 40 detect a strike earlier than the central sensor 10, as long as the central sensor 10 detects the strike within the scan time of the peripheral sensors, the scan time of the central sensor 10 starts. Then, after the scan time of the central sensor 10 has elapsed, the velocity is calculated based on results of detecting a strike by the central sensor 10 and the first peripheral sensor 20 to the third peripheral sensor 40. Therefore, in cases in which the first peripheral sensor 20 to the third peripheral sensor 40 detect a strike earlier than the central sensor 10, and in cases in which the first peripheral sensor 20 to the third peripheral sensor 40 detect a strike later than the central sensor 10, the velocity can be calculated using detection results of the central sensor 10 with high sensitivity.

Here, in this case, an instruction for generating a musical sound is delayed for a time from when the first peripheral sensor 20 to the third peripheral sensor 40 detect a strike until the central sensor 10 detects the strike. However, a period for which it is determined whether the central sensor 10 detects a strike is within the scan time of the peripheral sensor from when the first peripheral sensor 20 to the third peripheral sensor 40 detect the strike. Therefore, a delay time of the instruction for generating a musical sound can be limited within the scan time of the peripheral sensor (that is, 2 ms). That is, a delay time of the instruction for generating a musical sound can be limited within a range of a design value by adjusting a measurement time of the scan time of the peripheral sensor.

In the process of S23, when the central sensor 10 has not detected a strike (No in S23), absolute values of values in the sensor peak value memory 73*c* of the central sensor 10 and the first peripheral sensor 20 to the third peripheral sensor 40 are compared with absolute values in the sensor value memory 73*a* of the corresponding sensor. Then, larger values are stored in the sensor peak value memory 73*c* (S25). After the process of S25, the peripheral sensor striking process is performed (S26). The peripheral sensor striking process will be described below with reference to FIG. 10. After the processes of S14, S17, S20, S22, and S26, the periodic process ends.

Next, the central sensor striking process (FIG. 8, S22) performed within the scan time of the central sensor 10 will be described with reference to FIG. 9. In the central sensor striking process, a strike position and a velocity are calculated from the values in the sensor peak value memory 73*c* and the values in the sensor value ring buffer 73*b* of the central sensor 10 and the first peripheral sensor 20 to the third peripheral sensor 40. Therefore, an instruction for generating a musical sound according to the strike position and the velocity is issued to the sound source 76, and a musical sound of the electronic drum 1 is generated.

First, in the central sensor striking process, it is checked whether the scan time is 2 ms or more (S30). The scan time of the central sensor 10, that is 2 ms after the central sensor 10 detects a strike is a so-called "waiting process" in which output values of the sensors according to the strike are monitored and a strike position and a velocity according to the strike are not calculated. In the central sensor striking process, it is checked whether the scan time has elapsed.

When the scan time is 2 ms or more (Yes in S30), the scan time of the central sensor 10 ends. Therefore, the central sensor scan flag 73*d* indicating that the time is within the scan time of the central sensor 10 is set to off, and measurement of the scan time is stopped (S31).

After the process of S31, it is checked whether the test mode flag 73*k* is in an off state (S32). That is, it is checked whether the electronic drum 1 is in the test mode. When the test mode flag 73*k* is an off state (Yes in S32), weighted computation of the values in the sensor peak value memory 73*c* of the central sensor 10 and the values in the sensor peak value memory 73*c* of the first peripheral sensor 20 to the third peripheral sensor 40 is performed. Then, the results are stored in the velocity memory 73*j* (S33). That is, in the central sensor striking process, a velocity (a strike strength) according to the strike is calculated by weighted computation of the peak values of the sensors. When the value in the sensor peak value memory 73*c* of the central sensor 10 is set to peak_c, and the values in the sensor peak value memory 73*c* of the first peripheral sensor 20 to the third peripheral sensor 40 are set to peak_s1, peak_s2, and peak_s3, respectively, a velocity V1 is calculated from weighted computation in Equation 1.

$$V1 = (\text{peak_c} * \text{gain_c} + \text{peak_s1} * \text{gain_s1} + \text{peak_s2} * \text{gain_s2} + \text{peak_s3} * \text{gain_s3}) * \text{gain_Mix_v} \quad \text{(Equation 1)}$$

Here, gain_c, gain_s1, gain_s2, and gain_s3 are gain constants, which are "0.3," "0.2," "0.2," and "0.2." In addition, gain_Mix_v is a value set by a user and is a value set by an input device (not shown) of the electronic drum 1. The velocity V1 calculated in Equation 1 is stored in the velocity memory 73*j*. Here, the gain constants are not necessarily limited to the above-described values, and may be appropriately set according to a size and a material of the struck surface, sensitivity of the central sensor 10 and the first peripheral sensor 20 to the third peripheral sensor 40, and the like.

After the process of S33, an initial half wave according to the strike in the central sensor 10 is acquired from the values in the sensor value ring buffer 73*b*. Then, the central sensor strike position table 72*b* is referred to according to the pitch ΔThw of the initial half wave and the corresponding strike position is stored in the central sensor strike position memory 73*g* (S34). Specifically, a position at which the value is a minimum is acquired with reference to the values in the central sensor value memory 73*b*1 of the sensor value ring buffer 73*b*. First, the values in the central sensor value memory 73*b*1 of the sensor value ring buffer 73*b* are referred to in the backward direction from the position, and a position at which the value is 0 is acquired. That is, this time is the time Ts in FIG. 6(*a*).

Then, from the values in the central sensor value memory 73*b*1 of the sensor value ring buffer 73*b*, in a direction in which the time progresses, with reference to the values in the central sensor value memory 73*b*1 of the sensor value ring buffer 73*b*, a position at which the value is 0 is acquired. That is, this time is the time Te in FIG. 6(*a*). Here, the values in the central sensor value memory 73*b*1 of the sensor value ring buffer 73*b* are referred to in the direction in which the time progresses. As a result, when there is no position at which the value is 0, a current position in the sensor value ring buffer 73*b* is set to the time Te. This is a case in which, when the vicinity of the center of the struck surface of the electronic drum 1 is struck, it is not possible to completely detect the initial half wave due to the vibration within the scan time of the central sensor 10. The countermeasure in this case will be described below in processes of S37 to S39.

The central sensor strike position table 72*b* is referred to according to a time difference between the time Ts and the time Te, that is, a value of the pitch ΔThw of the initial half wave, and the corresponding strike position is stored in the central sensor strike position memory 73*g*.

After the process of S34, a detection time of the strike in the first peripheral sensor 20 to the third peripheral sensor 40 is acquired from the values in the sensor value ring buffer 73*b* (S35). Specifically, a position at which the value is a minimum (that is, "No." in FIG. 5(*c*)) is acquired with reference to the values in the first peripheral sensor value memory 73*b*2, the second peripheral sensor value memory 73*b*3, and the third peripheral sensor value memory 73*b*4 of the sensor value ring buffer 73*b*. Then, when a difference between the position and a current storage position (that is, a storage position stored in S10 in FIG. 8) in the sensor value ring buffer 73*b* is multiplied by 100 μs, times at which the values are minimum, which are, peak times Tm1, Tm2, and Tm3 in FIG. 6(*b*), are calculated.

Then, the peripheral sensor strike position table 72*c* is referred to according to a time difference ΔT1 between the peak times Tm1 and Tm2 and a time difference ΔT2 between the peak times Tm11 and Tm3, and the corresponding strike position is stored in the peripheral sensor strike position memory 73*h* (S36).

After the process of S36, it is checked whether the value in the peripheral sensor strike position memory 73*h* is 75 or more (S37). When the value in the peripheral sensor strike position memory 73*h* is 75 or more (Yes in S37), "0.5" is set in the central sensor strike position gain memory 73*f* (S38). On the other hand, when the value in the peripheral sensor strike position memory 73*h* is less than 75 (No in S37), "0" is set in the central sensor strike position gain memory 73*f* (S39). As described above, when the vicinity of the center of the struck surface of the electronic drum 1 is struck, the vicinity of the center of the struck surface greatly vibrates, and thus the central sensor 10 may not detect the initial half wave within the scan time. The strike position for the central sensor 10 is acquired from the central sensor strike position table 72*b* according to the pitch ΔThw of the initial half wave. Therefore, if it is not possible to completely detect the initial half wave, it is not possible to acquire the strike position.

However, in this case, the strike position is acquired accurately according to a strike detection time difference between the first peripheral sensor 20 to the third peripheral sensor 40 described in the process of S35. This is because detection of the strike by the first peripheral sensor 20 to the third peripheral sensor 40 is earlier than complete detection of the pitch ΔThw of the initial half wave by the central sensor 10. Accordingly, when a strike position (that is, the value in the peripheral sensor strike position memory 73*h*) according to a strike detection time difference between the first peripheral sensor 20 to the third peripheral sensor 40 is less than "75" (that is, when it is close to the vicinity of the center of the struck surface of the electronic drum 1), "0" is set in the central sensor strike position gain memory 73*f*. That is, when the strike position is calculated according to weighted computation (to be described below), the strike position for the central sensor 10 is not considered. Accordingly, when the vicinity of the center of the struck surface of the electronic drum 1 is struck and there is a possibility that the strike position cannot be accurately acquired by the central sensor 10, a strike position is calculated using only the strike position acquired by the first peripheral sensor 20 to the third peripheral sensor 40. Therefore, it is possible to acquire the strike position accurately.

On the other hand, when the value in the peripheral sensor strike position memory 73*h* is "75" or more (that is, when it is further from the center of the struck surface of the electronic drum 1), "0.5" is set in the central sensor strike position gain memory 73*f*. That is, when the strike position is calculated according to weighted computation (to be described below), the strike position for the central sensor 10 is considered. The strike position for the central sensor 10 is accurately calculated when the position is "75" or more. On the other hand, the strike position for the first peripheral sensor 20 to the third peripheral sensor 40 is accurately calculated when the position is less than "100." Accordingly, when the strike position is calculated using the strike position for the central sensor 10 and the strike position for the first peripheral sensor 20 to the third peripheral sensor 40 in combination, it is possible to acquire the strike position with higher accuracy. Here, the value in the central sensor strike position gain memory 73*f* set in this case is not necessarily limited to "0.5," and may be appropriately set according to a size, a material, and the like of the struck surface.

After the processes of S38 and S39, the strike position is calculated according to weighted computation of the value in the central sensor strike position memory 73*g*, the value in the peripheral sensor strike position memory 73*h*, and the value in the central sensor strike position gain memory 73*f*. Then, the calculated strike position is stored in the strike position memory 73*i* (S40). When the value in the central sensor strike position memory 73*g* is set to position_center and the value in the peripheral sensor strike position memory 73*h* is set to position_sub, strike position Ps is calculated according to weighted computation in Equation 2.

$$Ps=(\text{position_center}*\text{pre_gain_}c+\text{position_sub}*(1-\text{pre_gain_}c))*\text{gain_Mix_}p \quad \text{(Equation 2)}$$

Here, pre_gain_c is the value in the central sensor strike position gain memory 73*f*. In addition, "(1−pre_gain_c)" is a weight coefficient for the strike position for the first peripheral sensor 20 to the third peripheral sensor 40. In addition, gain_Mix_p is a value set by a user, and is a value set by the input device (not shown) of the electronic drum 1. The strike position Ps calculated in Equation 2 is stored in the strike position memory 73*i*. After the process of S40, an instruction for generating a musical sound according to the value in the strike position memory 73*i* and the value in the velocity memory 73*j* is output to the sound source 76 (S41).

In the process of S32, when the test mode flag 73*k* is in an on state (No in S32), a SysEx message including values in the sensor peak value memory 73*c* of the central sensor 10 and the first peripheral sensor 20 to the third peripheral sensor 40 is output (S42). In addition, in the process of S30, when the scan time is less than 2 ms, the processes of S31 to S42 are skipped. Then, after the processes of S30, S41, and S42, the central sensor striking process ends, and the process returns to the periodic process in FIG. 8.

Next, the peripheral sensor striking process (FIG. 8, S26) that is performed when the central sensor 10 does not detect a strike within the scan time of the peripheral sensor such as a case in which the outer peripheral side of the struck surface is weakly struck will be described with reference to FIG. 10. In the peripheral sensor striking process, a strike position and a velocity are calculated from the values in the sensor value ring buffer 73*b* of the first peripheral sensor 20 to the third peripheral sensor 40. Here, the strike position in this case is set to "100 (fixed value)" (refer to FIG. 3). Then, an instruction for generating a musical sound according to the strike position and the velocity is issued to the sound source 76, and a musical sound of the electronic drum 1 is generated.

First, in the peripheral sensor striking process, it is checked whether the scan time is 2 ms or more (S50). The scan time of the peripheral sensor, that is 2 ms after the first peripheral sensor 20 to the third peripheral sensor 40 detect a strike is a so-called "waiting process" in which output values of the sensors according to the strike are monitored and a strike position and a velocity according to the strike are not calculated. Accordingly, it is checked whether the scan time has elapsed.

When the scan time is 2 ms or more (Yes in S50), the scan time of the first peripheral sensor 20 to the third peripheral sensor 40 ends. Therefore, the peripheral sensor scan flag 73*e* indicating that the time is within the scan time of the first peripheral sensor 20 to the third peripheral sensor 40 is set to off, and measurement of the scan time is stopped (S51). After the process of S51, it is checked whether the test mode flag 73*k* is in an off state (S52). When the test mode flag 73*k* is an off state (Yes in S52), weighted computation of the values in the sensor peak value memory 73*c* of the first peripheral sensor 20 to the third peripheral sensor 40 is performed. Then, the results are stored in the velocity memory 73*j* (S53). That is, in the peripheral sensor striking process, a velocity (a strike strength) according to the strike is calculated according to weighted computation of the peak values of the first peripheral sensor 20 to the third peripheral sensor 40. When the values in the sensor peak value memory 73*c* of the first peripheral sensor 20 to the third peripheral sensor 40 are set to peak_s1, peak_s2, and peak_s3, respectively, the velocity V1 is calculated according to weighted computation in Equation 3.

$$V1=(\text{peak_}s1*\text{gain_}s1+\text{peak_}s2*\text{gain_}s2+\text{peak_}s3*\text{gain_}s3)*\text{gain_Mix_}v \quad \text{(Equation 3)}$$

Here, gain_s1, gain_s2, and gain_s3 are gain constants, which are "0.2," "0.2," and "0.2." Here, the gain constants are not necessarily limited to the above-described values, and may be appropriately set according to a size and a material of the struck surface, the detection sensitivities of the first peripheral sensor 20 to the third peripheral sensor 40, and the like. In addition, gain_Mix_v is a value set by a user and is a value set by the input device (not shown) of the electronic drum 1. Here, gain_Mix_v is not limited to the same value as in gain_Mix_v in Equation 1, and another value may be set.

After the process of S53, "100" is stored in the strike position memory 73*i* (S54). Conditions in which S54 is performed comprise that the peripheral sensor scan flag 73*e* being in an on state (FIG. 8, Yes in S12), the central sensor 10 does not detect a strike (FIG. 8, No in S22), and the scan time being 2 ms or more (Yes in S50). That is, a strike is detected in any of the first peripheral sensor 20 to the third peripheral sensor 40, but the central sensor 10 does not detect the strike within the scan time. In other words, the struck surface of the electronic drum 1 is weakly struck at the peripheral portion of the struck surface. This comprises not only a case in which the outer peripheral side relative to the first peripheral sensor 20 to the third peripheral sensor 40 is weakly struck but also a case in which the inner circumference side relative to the first peripheral sensor 20 to the third peripheral sensor 40 is weakly struck, and the central sensor 10 does not detect the strike. When the inner circumference side relative to the first peripheral sensor 20 to the third peripheral sensor 40 is weakly struck, the strike position is accurately calculated from the time differences ΔT1 and ΔT2 of the peak of the strike. On the other hand, when the outer peripheral side is weakly struck, as described above, the strike position is not accurately calculated from the time differences ΔT1 and ΔT2 of the peak of the strike and the positions of the first peripheral sensor 20 to the third peripheral sensor 40 are set as strike positions. In addition, since the central sensor 10 does not detect the strike, it is not possible to calculate the strike position from the pitch ΔThw of the initial half wave of the central sensor 10. Therefore, in the present embodiment, in order to simplify the process, when a strike is detected in any of the first peripheral sensor 20 to the third peripheral sensor 40 but the central sensor 10 does not detect the strike, the strike position is set to the position "100" the same as those of the first peripheral sensor 20 to the third peripheral sensor 40, and the strike position is used for an instruction for generating a musical sound.

After the process of S54, an instruction for generating a musical sound according to the value in the strike position memory 73*i* and the value in the velocity memory 73*j* is output to the sound source 76 (S55).

When the central sensor 10 does not detect a strike within the scan time of the peripheral sensor such as a case in which the peripheral portion of the struck surface is weakly struck to an extent that the central sensor 10 is not able to detect the strike, the weak strike is detected by the first peripheral sensor 20 to the third peripheral sensor 40 and an instruction for generating a musical sound is issued. That is, after the first peripheral sensor 20 to the third peripheral sensor 40 detect a strike, when the central sensor 10 does not detect the strike within the scan time of the peripheral sensor, an instruction for generating a musical sound is issued without waiting for detection of the strike by the central sensor 10. Accordingly, in this case, an instruction for generating a musical sound is not delayed.

In the process of S52, when the test mode flag 73*k* is in an on state (No in S52), a SysEx message including the values in the sensor peak value memory 73*c* of the central sensor 10 and the first peripheral sensor 20 to the third peripheral sensor 40 is output (S56). In addition, in the process of S50, when the scan time is less than 2 ms, the processes of S51 to S56 are skipped. Then, after the processes of S50, S55, and S56, the peripheral sensor striking process ends, and the process returns to the periodic process in FIG. 8.

As described above, when the strike position for the first peripheral sensor 20 to the third peripheral sensor 40 is 0 to 75, a strike is performed on the central portion of the struck surface of the electronic drum 1, and there is a possibility that the pitch ΔThw of the initial half wave is not completely detected by the central sensor 10. Therefore, a strike position is calculated using only the strike position for the first peripheral sensor 20 to the third peripheral sensor 40. That is, in Equation 2, pre_gain_c (the value in the central sensor strike position gain memory 73*f*) is set to "0." Then, when the strike position for the first peripheral sensor 20 to the third peripheral sensor 40 is 75 to 100, it is a range in which a strike position is detected using the central sensor 10 and the first peripheral sensor 20 to the third peripheral sensor 40 together. Therefore, the strike position is calculated according to weighted computation of both positions. In this case, in Equation 2, pre_gain_c (the value in the central sensor strike position gain memory 73*f*) is set to "0.5." Here, the value of pre_gain_c set in this case is not necessarily limited to "0.5" and may be appropriately set according to a size, a material, and the like of the struck surface.

Therefore, when the strike position for the first peripheral sensor 20 to the third peripheral sensor 40 is 100 or more, it indicates a position on the outer peripheral side relative to the positions (the position of "100" in FIG. 3) of the first peripheral sensor 20 to the third peripheral sensor 40. In the present embodiment, as shown in FIG. 5(*b*), when the strike position for the first peripheral sensor 20 to the third peripheral sensor 40 is a position on the outer peripheral side relative to the first peripheral sensor 20 to the third peripheral sensor 40, the position is "100" the same as those of the first peripheral sensor 20 to the third peripheral sensor 40. Meanwhile, since the strike position for the central sensor 10 is accurately acquired, a strike position is calculated according to weighted computation of both positions.

In addition, when the central sensor 10 detects a strike earlier than the first peripheral sensor 20 to the third peripheral sensor 40, an instruction for generating a musical sound is issued after the scan time of the central sensor 10, which is 2 ms. When the first peripheral sensor 20 to the third peripheral sensor 40 detect a strike earlier than the central sensor 10 and then the central sensor 10 has not detected the strike, an instruction for generating a musical sound is issued after the scan time of the peripheral sensor, which is 2 ms. When the first peripheral sensor 20 to the third peripheral sensor 40 detect a strike earlier than the central sensor 10 and then the central sensor 10 detects the strike, an instruction for generating a musical sound is not issued until the scan time for a maximum of 4 ms (the scan time of the central sensor 10+the scan time of the peripheral sensor) has elapsed. However, in the related art, after the scan time, that is 2 ms from when the central sensor 10 detects a strike, an instruction for generating a musical sound is issued. The present embodiment is the same as the related art in that an instruction for generating a musical sound is issued after the scan time of the central sensor 10, that is 2 ms from when the central sensor 10 detects a strike. However, the present embodiment is different from the related art in that the first peripheral sensor 20 to the third peripheral sensor 40 detect a strike before the central sensor 10 detects a strike. Accordingly, a strike position and a velocity are calculated after the scan time of the central sensor 10 and/or the scan time of the peripheral sensor from when the central sensor 10 or the first peripheral sensor 20 to the third peripheral sensor 40 detect a strike, that is, after a maximum of 4 ms. Therefore, an instruction for generating a musical sound is not delayed. Accordingly, it is possible to play the electronic drum 1 having favorable responsiveness to a strike.

As described above, when a weight of a strike by the central sensor 10 and the first peripheral sensor 20 to the third peripheral sensor 40 used to calculate a strike position is changed according to the detected strike position, it is possible to calculate the strike position more accurately.

As described above, the electronic drum 1 in the present embodiment comprises the central sensor 10 disposed at the center of the struck surface and the first peripheral sensor 20 to the third peripheral sensor 40 disposed at the peripheral portions of the struck surface. In addition, the first peripheral sensor 20 to the third peripheral sensor 40 are disposed at equal intervals along the circumference centered on the central sensor 10. Furthermore, the first peripheral sensor 20 to the third peripheral sensor 40 are disposed at positions at which, whichever position inside the circumference is struck, all of the first peripheral sensor 20 to the third peripheral sensor 40 can detect the strike within the scan time of the central sensor 10, that is 2 ms after the central sensor 10 detects the strike. Then, a velocity (a strike strength) and a strike position according to sensor output values detected by the sensors according to the strike on the struck surface of the electronic drum 1 are calculated. Therefore, an instruction for generating a musical sound is issued based on the calculated velocity and strike position.

First, the velocity is calculated based on the peak of the strike detected by the central sensor 10 and the first peripheral sensor 20 to the third peripheral sensor 40. Specifically, when the central sensor 10 detects a strike earlier than the first peripheral sensor 20 to the third peripheral sensor 40 according to the strike on the struck surface of the electronic drum 1, the scan time of the central sensor 10 is measured from when the central sensor 10 detects the strike. Then, after the scan time ends, a velocity is calculated based on the peak of the strike detected by the central sensor 10 and the first peripheral sensor 20 to the third peripheral sensor 40.

In this manner, the velocity is calculated based on the peak of the strike detected by the central sensor 10 and the first peripheral sensor 20 to the third peripheral sensor 40. Therefore, a distribution of strike sensitivities of the struck surface can be substantially uniformized so that a so-called hotspot in which a striking sound becomes abnormally loud in a central portion of the struck surface in which the central sensor 10 is provided can be removed. In addition, when the struck surface is formed in a large size, a strike detection time difference between the central sensor 10 and the first peripheral sensor 20 to the third peripheral sensor 40 may increase as a result. However, in this case, when the central sensor 10 detects a strike earlier than the first peripheral sensor 20 to the third peripheral sensor 40, since the velocity is calculated after the scan time (that is, 2 ms) from when the central sensor 10 detects the strike, an instruction for generating a musical sound is not delayed.

When the central sensor 10 does not detect a strike within the scan time of the peripheral sensor such as a case in which the peripheral portion of the struck surface is weakly struck to an extent that the central sensor 10 is not able to detect the strike, the weak strike is detected by the first peripheral sensor 20 to the third peripheral sensor 40, and an instruction for generating a musical sound is issued. That is, after the first peripheral sensor 20 to the third peripheral sensor 40 detect a strike, when the central sensor 10 does not detect the strike within the scan time of the peripheral sensor, an instruction for generating a musical sound is issued without waiting for detection of the strike by the central sensor 10. Accordingly, in this case, an instruction for generating a musical sound is not delayed.

On the other hand, a strike position is calculated based on the strike position from the central sensor 10 and the strike position from the first peripheral sensor 20 to the third peripheral sensor 40. Specifically, first, the strike position for the first peripheral sensor 20 to the third peripheral sensor 40 of the electronic drum 1 is calculated with reference to the peripheral sensor strike position table 72*c* according to a difference ΔT1 in times at which the peaks of the first peripheral sensor 20 and the second peripheral sensor 30 are detected and a difference ΔT2 in times at which the peaks of the first peripheral sensor 20 and the third peripheral sensor 40 are detected. On the other hand, the strike position for the central sensor 10 is calculated with reference to the central sensor strike position table 72*b* according to the pitch ΔThw of the initial half wave of the strike detected by the central sensor 10. Then, a strike position is calculated according to weighted computation of the strike position for the first peripheral sensor 20 to the third peripheral sensor 40 and the strike position for the central sensor 10.

The first peripheral sensor 20 to the third peripheral sensor 40 are disposed at positions at which, whichever position inside the circumference is struck, all of the first peripheral sensor 20 to the third peripheral sensor 40 can detect the strike within the scan time of the central sensor 10, that is 2 ms after the central sensor 10 detects the strike. Then, detection of the strike by the first peripheral sensor 20 to the third peripheral sensor 40 is performed within the scan time of the central sensor 10, and a strike position in the circumference in which the first peripheral sensor 20 to the third peripheral sensor 40 are disposed can be calculated by the first peripheral sensor 20 to the third peripheral sensor 40. On the other hand, a strike position of the peripheral portion of the struck surface is calculated based on the pitch ΔThw of the initial half wave detected by the central sensor 10. Therefore, depending on a strike position indicated by the strike position calculated by the first peripheral sensor 20 to the third peripheral sensor 40, according to weighted computation of the strike position obtained from the first peripheral sensor 20 to the third peripheral sensor 40 and the strike position obtained from the central sensor 10, a strike position is calculated. Since the strike position is calculated according to the weighted computation, it is possible to calculate the strike position more accurately.

Here, the first peripheral sensor 20 to the third peripheral sensor 40 are disposed at positions (positions of "100" in FIG. 3) at which, when the struck surface is struck, peaks due to the same strike can be detected by all of the first peripheral sensor 20 to the third peripheral sensor 40 within the scan time of the central sensor 10, that is 2 ms after the central sensor 10 detects the strike. Therefore, detection by the first peripheral sensor 20 to the third peripheral sensor 40 is performed within the scan time of the central sensor 10, and the strike position for the first peripheral sensor 20 to the third peripheral sensor 40 in the circumference in which the first peripheral sensor 20 to the third peripheral sensor 40 are disposed can be calculated. On the other hand, the strike position for the central sensor 10 is calculated based on the pitch ΔThw of the initial half wave detected by the central sensor 10.

Here, the first peripheral sensor 20 to the third peripheral sensor 40 are disposed at positions at which, when the struck surface is struck, the pitch ΔThw of the initial half wave can be detected within the scan time of the central sensor 10 after the central sensor 10 detects the strike. Therefore, when a position outside the circumference is struck, the central sensor 10 can detect the pitch ΔThw of the initial half wave within the scan time of the central sensor 10 and the strike position for the central sensor 10 is calculated based on the detected result. Therefore, a strike position is calculated according to weighted computation of the strike position for the central sensor 10 and the strike position for the first peripheral sensor 20 to the third peripheral sensor 40. On the other hand, when a position that is in the circumference and the vicinity of the center of the struck surface of the electronic drum 1 is struck, there is a possibility that the pitch ΔThw of the initial half wave is not completely detected by the central sensor 10. Therefore, if the strike position for the first peripheral sensor 20 to the third peripheral sensor 40 is the vicinity of the center of the struck surface of the electronic drum 1 (that is, a position of "75" or less), when the strike position is calculated after the scan time of the central sensor 10, the strike position for the first peripheral sensor 20 to the third peripheral sensor 40 is set as a strike position. Accordingly, even if it is not possible for the central sensor 10 to completely detect the pitch ΔThw of the initial half wave, it is possible to calculate the strike position within the scan time of the central sensor 10.

In this manner, the strike position in the circumference is calculated with reference to the peripheral sensor strike position table 72*c* according to the time difference ΔT1 between the peaks of the first peripheral sensor 20 and the second peripheral sensor 30 and the time difference ΔT2 between the peaks of the first peripheral sensor 20 and the third peripheral sensor 40. Further, a strike position outside the circumference is calculated with reference to the central sensor strike position table 72*b* according to the pitch ΔThw of the initial half wave detected by the central sensor 10. Accordingly, a strike position inside or outside the circumference can be calculated based on the result of detection of the strike within the scan time of the central sensor 10. Therefore, even if the struck surface is formed in a large size, it is possible to quickly calculate the strike position. That is, an instruction for generating a musical sound is not delayed.

When only the central sensor 10 is used in order to detect a strike strength (a velocity), a so-called hotspot is generated in the vicinity of the center of the struck surface. In addition, when the peripheral portion of the struck surface is weakly struck, there is a risk that the strike is not detected. In order to eliminate the risk, the first peripheral sensor 20 to the third peripheral sensor 40 are added in the present embodiment.

In addition, when only the first peripheral sensor 20 to the third peripheral sensor 40 are used in order to detect a strike position, it is not possible to detect a strike position on the outer peripheral side relative to the first peripheral sensor 20 to the third peripheral sensor 40. In order to address this problem, if the first peripheral sensor 20 to the third peripheral sensor 40 are arranged on the outermost periphery of the struck surface, it takes a long time for all of the first peripheral sensor 20 to the third peripheral sensor 40 to detect a strike and an instruction for generating a musical sound is delayed. When the peripheral sensors are arranged on the inner circumference side in order to reduce the delay, it is not possible to detect a strike position on the outer peripheral side relative to the first peripheral sensor 20 to the third peripheral sensor 40. Therefore, in the present embodiment, when the central sensor 10 is used in addition to the first peripheral sensor 20 to the third peripheral sensor 40, it is possible to detect a strike position of the peripheral portion (that is, on the outer peripheral side relative to the first peripheral sensor 20 to the third peripheral sensor 40) of the struck surface while reducing the delay of an instruction for generating a musical sound.

The present invention has been described above based on the embodiment. However, it can be easily understood that the present invention is not limited to the above-described embodiment, and various improvements and modifications can be made without departing from the spirit and scope of the present invention.

The electronic drum 1 has been described as an exemplary electronic percussion instrument in the above embodiment. However, the present invention is not necessarily limited thereto, and may be applied for the simulation of other percussion instruments such as a bass drum, a snare drum, a tom-tom drum, and a cymbal.

A case in which the cushion member 24 of the first peripheral sensor 20 to the third peripheral sensor 40 is formed of the same elastic material as the cushion member 14 of the central sensor 10 has been described in the above embodiment. However, the present invention is not necessarily limited thereto. For example, when the cushion member 24 is formed of an elastic material such as sponge, rubber, and a thermoplastic elastomer, an elastic material having higher hardness than the cushion member 14 is preferably used. Accordingly, when the central portion of the struck surface is struck, a time from when the central sensor 10 detects the strike until the first peripheral sensor 20 to the third peripheral sensor 40 detect the strike can be shortened. Therefore, a delay time of sound production control can be shortened.

A case in which the thickness of the cushion member 24 of the first peripheral sensor 20 to the third peripheral sensor 40 is less than the thickness of the cushion member 14 of the central sensor 10 (an interval between the head sensor 23 and the struck surface is shortened) has been described in the above embodiment. Therefore, it is possible to shorten a time until the head sensor 23 of the first peripheral sensor 20 to the third peripheral sensor 40 detects a strike. However, the present invention is not necessarily limited thereto. For example, the cushion member 14 and the cushion member 24 may be formed to have the same thickness (alternatively, the thickness of the cushion member 24 may be greater than the thickness of the cushion member 14).

In this case, when the hardness of the material of the cushion member 24 is increased (the cushion member 24 is formed of a material in which vibration due to a strike is rapidly transmitted), a time until the head sensor 23 of the first peripheral sensor 20 to the third peripheral sensor 40 detects the strike can be shortened. That is, at least the first peripheral sensor 20 to the third peripheral sensor 40 may be configured to transmit a strike signal in a shorter time than the central sensor 10 when the struck surface is struck, and a method thereof is not limited.

Accordingly, when the central portion of the struck surface is struck, a time from when the central sensor 10 detects the strike until the first peripheral sensor 20 to the third peripheral sensor 40 detect the strike can be shortened. Therefore, a delay time of sound production control can be shortened (a delay of an instruction for generating a musical sound can be shortened).

In addition, when the hardness of the material of the cushion member 24 is set to be higher than that of the cushion member 14, the cushion member 14 and the cushion member 24 are formed of the same elastic material and only the hardness of the cushion member 24 is increased, this is more preferable. Therefore, even if there is a difference between the hardnesses of the cushion member 14 and the cushion member 24 (compared to when both the hardness and the material are different), characteristics (such as a waveform, a level, and a response time) of strike outputs in the central sensor 10 and the first peripheral sensor 20 to the third peripheral sensor 40 can be easily matched.

In the above embodiment, the central sensor 10 and the first peripheral sensor 20 to the third peripheral sensor 40 comprise a piezoelectric element. However, the present invention is not necessarily limited thereto. A sensor capable of detecting a strike on the struck surface such as an acceleration sensor and a pressure sensor can be applied as the central sensor 10 and the first peripheral sensor 20 to the third peripheral sensor 40.

A case in which the struck surface (the film member 3*a*) is formed in a disc shape has been described in the above embodiment. However, the present invention is not necessarily limited thereto. The struck surface may be formed in a rectangular shape, a polygonal shape, or a shape in which curved lines and straight lines are combined. That is, regardless of the shape of the struck surface, as in the present embodiment, one central sensor 10 and at least three peripheral sensors (first peripheral sensor 20 to the third peripheral sensor 40) disposed at equal intervals along the circumference centered on the central sensor 10 may be arranged in a region that is formed as the struck surface.

That is, accordingly, a strike position in the circumference in which the first peripheral sensor 20 to the third peripheral sensor 40 are disposed can be detected from a time difference between the peaks detected by the first peripheral sensor 20 to the third peripheral sensor 40. In addition, according to the waveform of a strike signal detected by one central sensor, a strike position outside the circumference in which the first peripheral sensor 20 to the third peripheral sensor 40 are disposed can be detected. Therefore, even if the struck surface is formed in a rectangular shape, a polygonal shape, or a shape in which curved lines and straight lines are combined, a strike position from the center of the struck surface can be appropriately detected by the central sensor 10 and the first peripheral sensor 20 to the third peripheral sensor 40.

In this case, the central sensor 10 may be disposed at a position further from the center, and at least the first peripheral sensor 20 to the third peripheral sensor 40 may be disposed at equal intervals along the circumference centered on the central sensor 10. Accordingly, a strike position can be appropriately calculated based on the results detected by the central sensor 10 and the first peripheral sensor 20 to the third peripheral sensor 40.

In the above embodiment, the first peripheral sensor 20 to the third peripheral sensor 40 are disposed at equal intervals along the circumference centered on the central sensor 10. However, the present invention is not necessarily limited thereto. The first peripheral sensor 20 to the third peripheral sensor 40 may be disposed along a line of a polygonal shape, an elliptical shape, or the like surrounding the central sensor 10 rather than along the circumference centered on the central sensor 10, and may be disposed at unequal intervals. In this case, the peripheral sensor strike position table 72*c* corresponding to such arrangement may be created according to actual measurement or the like, and the strike position may be calculated. In addition, the gain constants in Equation 1 may be appropriately set according to actual measurement and the velocity may be calculated.

In the above embodiment, one central sensor 10 is disposed at the center of the struck surface. However, the present invention is not necessarily limited thereto. Two or more central sensors 10 may be disposed. In this case, in place of the result of detection of the strike by one central sensor 10 in the above embodiment, an average value of results of detection of the strike by the plurality of central sensors 10 and the like may be used when the velocity and the strike position are calculated.

In the above embodiment, three peripheral sensors that are the first peripheral sensor 20 to the third peripheral sensor 40 are disposed at equal intervals along the circumference centered on the central sensor 10. However, the present invention is not necessarily limited thereto. Three or more peripheral sensors may be disposed. In this case, the peripheral sensors are disposed at equal intervals along the circumference centered on the central sensor 10. Using a peripheral sensor as a base point, a time difference between peaks of the strike in the peripheral sensors is stored in the peripheral sensor strike position table 72*c*. Then, when a strike is detected, a strike position may be acquired with reference to the peripheral sensor strike position table 72*c* according to the time difference between peaks of the strike in the peripheral sensors.

In addition, two peripheral sensors may be disposed. In this case, a strike position in a linear direction connecting the two peripheral sensors can be detected. A strike position can be calculated according to weighted computation of the strike position obtained from the two peripheral sensors and the strike position obtained from the pitch ΔThw of the initial half wave of the central sensor 10. However, it is not possible to detect a strike position in a direction intersecting a straight line connecting the two peripheral sensors.

Alternatively, one peripheral sensor may be disposed. In this case, the peripheral sensor is one circular ring sensor (the sensor itself has a ring shape or is one sensor configured to detect vibration of a ring-shaped member that comes in contact with the head) centered on the central sensor 10. In this case, the velocity is calculated by weighted computation of a peak value of the strike detected by the central sensor 10 and a peak value of the strike detected by the ring sensor. Then, first, the strike position is calculated according to a time difference between the peak of the strike detected by the ring sensor and the peak of the strike detected by the central sensor 10 (hereinafter referred to as a "strike position according to a time difference"). Accordingly, a strike position in the circumference in which the ring sensor is disposed can be calculated.

When the strike position according to a time difference is a position (for example, on the outer peripheral side relative to a position of "75" in FIG. 3) at which the pitch ΔThw of the initial half wave of the central sensor 10 can be completely detected within the scan time of the central sensor 10, weighted computation of the strike position according to a time difference and the strike position calculated according to the pitch ΔThw of the initial half wave of the central sensor 10 is performed. A strike position is calculated based on the result. On the other hand, when the result of the strike position according to a time difference is a position at which it is not possible to completely detect the pitch ΔThw of the initial half wave of the central sensor 10 within the scan time of the central sensor 10, the strike position according to a time difference is set as a strike position.

In this manner, a strike position in the circumference in which the ring sensor is disposed is calculated according to a time difference between the peak of the strike detected by the ring sensor and the peak of the strike detected by the central sensor 10. On the other hand, a strike position outside the circumference in which the ring sensor is disposed is calculated based on the pitch ΔThw of the initial half wave of the central sensor 10. Accordingly, a strike position inside or outside the circumference can be calculated based on the detection result of the strike within the scan time of the central sensor 10. Therefore, when the struck surface is formed in a large size, it is possible to quickly calculate the strike position. Therefore, an instruction for generating a musical sound is not delayed.

In addition, when the strike position according to a time difference is a position of the ring sensor, it is not possible to determine whether the position of the ring sensor is struck or the outer peripheral side relative to the ring sensor is struck. In this case, the strike position calculated according to the pitch ΔThw of the initial half wave of the central sensor 10 may be set as a strike position.

In the above, the strike position according to a time difference is calculated according to a time difference between the peak of the strike detected by the ring sensor and the peak of the strike detected by the central sensor 10. However, a strike position may be calculated according to a difference or a ratio between the peak value of the strike detected by the ring sensor and the peak value of the strike detected by the central sensor 10. In addition, a strike position may be calculated according to a detection time difference (that is, a difference between signal arrival times) of a falling (or rising) edge between the ring sensor and the central sensor 10.

In the above, the strike position for the central sensor 10 is calculated according to the pitch ΔThw of the initial half wave. However, a strike position may be calculated based on a peak position of the initial half wave detected by the central sensor 10, an area of the initial half wave, or the like.

As described above, a strike position can be calculated by weighted computation of the strike position obtained from (a difference or a ratio between strike detection times or strike strengths of) a plurality of sensors in the central sensor 10 and at least one peripheral sensor and the strike position obtained from the initial half wave of the central sensor 10.

In the above embodiment, measurement times for the scan time of the central sensor 10 and the scan time of the peripheral sensor each are 2 ms. However, the present invention is not necessarily limited thereto. The measurement time may be set to 2 ms or more or 2 ms or less according to a size of the struck surface or a material of the struck surface. In addition, measurement times for the scan time of the central sensor 10 and the scan time of the peripheral sensor may be different. For example, the central sensor 10 may be set to have a longer scan time as the peak appears later than the first peripheral sensor 20 to the third peripheral sensor 40 and the first peripheral sensor 20 to the third peripheral sensor 40 may be set to have a shorter scan time as the peak appears earlier.

In the above embodiment, when the central sensor 10 detects a strike within the scan time of the peripheral sensor, the scan time of the peripheral sensor is stopped, and the scan time of the central sensor 10 starts. However, the present invention is not necessarily limited thereto. The scan time of the central sensor 10 may not be provided even if the central sensor 10 detects a strike within the scan time of the peripheral sensor. In this case, after the scan time of the peripheral sensor, a velocity and a strike position are calculated from the values in the sensor value ring buffer 73*b* and the values in the sensor peak value memory 73*c* obtained so far, and an instruction for generating a musical sound is issued. In this case, for the velocity, the value in the sensor peak value memory 73*c* of the central sensor 10 obtained within the scan time of the peripheral sensor may be set as a peak value of the central sensor 10.

In addition, when any of the first peripheral sensor 20 to the third peripheral sensor 40 detects a strike earlier than the central sensor 10, it is conceivable that a position closer to the first peripheral sensor 20 to the third peripheral sensor 40 than to the central sensor 10 is struck. Furthermore, for the strike position, a predetermined position (for example, a position of "100") from an intermediate position (a position of "50") between the central sensor 10 and the first peripheral sensor 20 to the third peripheral sensor 40 to the outermost periphery (a position of "127") may be set as a strike position. A difference between a time at which the initial half wave of the central sensor 10 obtained within the scan time of the peripheral sensor starts and a time at which the scan time of the peripheral sensor ends may be set as the pitch ΔThw of the initial half wave of the central sensor 10. In this case, in Equation 2, pre_gain_c (that is, the value in the central sensor strike position gain memory 73*f*) may be set to a value (for example, 0.6) that is greater than usual, and a strike position may be calculated according to weighted computation in Equation 2. Accordingly, there is no need to wait for the scan time of the central sensor 10. Therefore, a delay of an instruction for generating a musical sound is additionally reduced, and a response to the strike becomes faster.

In the above embodiment, when the central sensor 10 detects a strike within the scan time of the peripheral sensor, the scan time of the peripheral sensor is stopped, and the scan time of the central sensor 10 starts. However, the present invention is not necessarily limited thereto. When the central sensor 10 detects a strike within the scan time of the peripheral sensor, the scan time of the peripheral sensor is stopped, and "the scan time of the central sensor 10+the peripheral sensor" starts, which may be distinguished from "the scan time of the central sensor 10." In this case, when the scan time is appropriately adjusted, for example, the scan time of the central sensor 10+the peripheral sensor is adjusted to a time shorter than 2 ms, it is possible to reduce the delay of an instruction for generating a musical sound.

In the above embodiment, when the strike position calculated by the first peripheral sensor 20 to the third peripheral sensor 40 is "75" or more, a strike position is calculated by weighted computation of the strike position for the central sensor 10 and the strike position for the first peripheral sensor 20 to the third peripheral sensor 40. On the other hand, when the strike position calculated by the first peripheral sensor 20 to the third peripheral sensor 40 is less than "75," a strike position is calculated using only the strike position calculated by the first peripheral sensor 20 to the third peripheral sensor 40. However, the present invention is not necessarily limited thereto. A region of the struck surface in which a strike position is calculated according to only the strike position calculated by the first peripheral sensor 20 to the third peripheral sensor 40 and a region of the struck surface in which a strike position is calculated according to only the strike position calculated by the central sensor 10 may be adjacent to each other.

In the above embodiment, a threshold value for determining whether a strike position is calculated according to only the strike position detected by the first peripheral sensor 20 to the third peripheral sensor 40 is a position of "75." However, the present invention is not necessarily limited thereto. According to strike detection characteristics of the central sensor 10 and the first peripheral sensor 20 to the third peripheral sensor 40 such as a size, a material, and the like of the struck surface, a boundary value may be a value of "75" or less or a value of "75" or more.

In the above embodiment, a strike position is acquired with reference to the central sensor strike position table 72*b* according to the pitch ΔThw of the initial half wave of a voltage waveform according to the strike of the central sensor 10. However, the present invention is not necessarily limited thereto. A strike position may be acquired from the pitch ΔThw of the initial half wave according to computation. In this case, the central sensor strike position table 72*b* may be omitted in a configuration. Therefore, it is possible to reduce the size of the ROM 72.

In the above embodiment, a strike position for the central sensor 10 is calculated with reference to the central sensor strike position table 72*b* according to the pitch ΔThw of the initial half wave detected by the central sensor 10. However, the present invention is not necessarily limited thereto. A strike position may be calculated based on a peak position of the initial half wave detected by the central sensor 10, an area of the initial half wave, or the like.

In the above embodiment, a strike position is acquired with reference to the peripheral sensor strike position table 72*c* according to the time differences ΔT1 and ΔT2 of the peak of the strike between the first peripheral sensor 20, and the second peripheral sensor 30 and the third peripheral sensor 40. However, the present invention is not necessarily limited thereto. A strike position may be acquired when the time differences ΔT1 and ΔT2 of the peak of the strike are computed. In this case, the peripheral sensor strike position table 72*c* may be omitted in a configuration. Therefore, it is possible to reduce the size of the ROM 72.

In the above embodiment, the strike position for the first peripheral sensor 20 to the third peripheral sensor 40 is calculated with reference to the peripheral sensor strike position table 72*c* according to the time difference ΔT1 between peaks of the first peripheral sensor 20 and the second peripheral sensor 30 and the time difference ΔT2 between peaks of the first peripheral sensor 20 and the third peripheral sensor 40. However, the present invention is not necessarily limited thereto. A strike position may be calculated based on a difference of peak values between the first peripheral sensor 20 to the third peripheral sensor 40 or a ratio between peak values.

In the above embodiment, the time difference between peaks of the first peripheral sensor 20 and the second peripheral sensor 30 is set as ΔT1, and the time difference between peaks of the first peripheral sensor 20 and the third peripheral sensor 40 is set as ΔT2. However, the present invention is not necessarily limited thereto. A detection time difference (that is, a difference between signal arrival times) of a falling (or rising) edge between the first peripheral sensor 20 to the second peripheral sensor 30 may be set as ΔT1, and a detection time difference of a falling (or rising) edge between the first peripheral sensor 20 and the third peripheral sensor 40 may be set as ΔT2. Then, the strike position for the first peripheral sensor 20 to the third peripheral sensor 40 may be calculated from the peripheral sensor strike position table 72*c* using ΔT1 and ΔT2.

In the above embodiment, when a strike position is acquired, the strike position is acquired according to a difference in detection times of the strike by the first peripheral sensor 20 to the third peripheral sensor 40. However, the present invention is not necessarily limited thereto. A strike position may be acquired according to a difference in detection times of the strike by the first peripheral sensor 20 to the third peripheral sensor 40, and the central sensor 10. In this case, a strike position according to a time difference of peaks of the central sensor 10, and the first peripheral sensor 20 to the third peripheral sensor 40 may be added to the peripheral sensor strike position table 72*c*.

What is claimed is:

1. An electronic percussion instrument comprising:

a struck surface; and a plurality of strike sensors configured to detect a strike on the struck surface, wherein the plurality of strike sensors comprise at least one central sensor that is disposed on a back side of the struck surface and disposed at a center side of the struck surface and a plurality of peripheral sensors that are disposed on a peripheral side of the struck surface, wherein the central sensor and the peripheral sensors each has a same structure and comprises a cushion member in contact with the struck surface and a head sensor disposed on a bottom surface of the cushion member, wherein the peripheral sensors are configured to transmit a strike signal in a shorter time than the central sensor when the struck surface is struck.

2. The electronic percussion instrument according to claim 1, wherein the peripheral sensors are disposed at closer positions to the struck surface than the central sensor.

3. The electronic percussion instrument according to claim 1, wherein an interval between the head sensor of each of the peripheral sensors and the struck surface is shorter than an interval between the head sensor of the central sensor and the struck surface.

4. The electronic percussion instrument according to claim 1, wherein each of the plurality of strike sensors is disposed on the back side of the struck surface with the cushion member therebetween, and wherein the cushion member of each of the peripheral sensors is formed to be thinner than the cushion member of the central sensor.

5. The electronic percussion instrument according to claim 1, wherein the cushion member of each of the plurality of strike sensors is formed with thickness at which, when each of locations of the strike sensors on the struck surface is hit, the struck surface does not bottom out on the head sensor.

6. The electronic percussion instrument according to claim 1, wherein the cushion member of each of the plurality of strike sensors is formed with thickness of about 1.5 to 2 times an amount of deflection of the struck surface when each of locations of the strike sensors on the struck surface is hit.

7. The electronic percussion instrument according to claim 1, wherein, when the struck surface is hit, the struck surface has a first deflection amount at the center side where the central sensor is disposed and a second deflection amount on the peripheral side where the peripheral sensors are disposed, wherein the thickness of the cushion member of the central sensor is 1.75 times the first deflection amount, and wherein the thickness of the cushion member of each of the peripheral sensors is 1.78 times the second deflection amount.

8. The electronic percussion instrument according to claim 1, wherein the cushion member of each of the peripheral sensors is formed with thickness at which, when a center of the struck surface is struck, a peak value of the strike is able to be detected within a predetermined time.

9. The electronic percussion instrument according to claim 1, wherein the at least one central sensor is one central sensor and the plurality of peripheral sensors are at least three peripheral sensors, the peripheral sensors are disposed along a circumference centered on the central sensor.

10. The electronic percussion instrument according to claim 1, wherein, when the struck surface is viewed in a plan view, the plurality of peripheral sensors are at least three peripheral sensors disposed to surround the central sensor.

11. The electronic percussion instrument according to claim 1, wherein the peripheral sensors are disposed along a circumference centered on the central sensor or a line of a polygonal shape or an elliptical shape to surround the central sensor.

12. The electronic percussion instrument according to claim 9, wherein the peripheral sensors are disposed at equal intervals.

13. The electronic percussion instrument according to claim 1, wherein the cushion member of each of the peripheral sensors and the central sensor comprises an elastic material, and a hardness of the elastic material of the cushion member of each of the peripheral sensors is higher than a hardness of the elastic material of the cushion member of the central sensor.

14. The electronic percussion instrument according to claim 1, wherein the at least one central sensor is a plurality of central centers, and wherein the electronic percussion instrument calculates a strike position based on an average value of strike results detected by the plurality of central sensors.

* * * * *